US008038846B2

(12) United States Patent
Polverari et al.

(10) Patent No.: US 8,038,846 B2
(45) **Date of Patent: *Oct. 18, 2011**

(54) COMPOSITION AND METHOD FOR PAPER PROCESSING

(75) Inventors: Marco Savio Polverari, Montreal (CA); Christopher Michael Lewis, Vancouver, WA (US); Matthew Gerard Fabian, Breezy Point, MN (US)

(73) Assignee: Kemira Oyj (FI)

( * ) Notice: Subject to any disclaimer, the term of this patent is extended or adjusted under 35 U.S.C. 154(b) by 0 days.

This patent is subject to a terminal disclaimer.

(21) Appl. No.: 11/855,475

(22) Filed: Sep. 14, 2007

(65) Prior Publication Data

US 2008/0128102 A1 Jun. 5, 2008

Related U.S. Application Data

(63) Continuation-in-part of application No. 11/531,911, filed on Sep. 14, 2006.

(51) Int. Cl.

| | |
|---|---|
| ***D21H 21/10*** | (2006.01) |
| ***D21H 17/09*** | (2006.01) |
| ***D21H 17/10*** | (2006.01) |
| ***D21H 23/14*** | (2006.01) |

(52) U.S. Cl. ..... 162/183; 162/158; 162/164.1; 162/168.1; 162/168.2; 162/168.3; 162/181.6; 162/181.8

(58) Field of Classification Search ..... 162/158, 162/164.1, 168.1, 168.3, 164.6, 164.3, 183, 162/181.1, 181.2, 181.3, 181.8, 179, 181.6–181.7
See application file for complete search history.

(56) References Cited

U.S. PATENT DOCUMENTS

| | | | | |
|---|---|---|---|---|
| 4,021,364 | A * | 5/1977 | Speiser et al. | 424/1.25 |
| 4,913,775 | A | 4/1990 | Langley et al. | |
| 4,929,655 | A | 5/1990 | Takeda et al. | |
| 4,968,435 | A | 11/1990 | Neff et al. | |
| 5,006,890 | A | 4/1991 | Takeda et al. | |
| 5,152,903 | A | 10/1992 | Neff et al. | |
| 5,167,766 | A | 12/1992 | Honig et al. | |
| 5,171,808 | A | 12/1992 | Ryles et al. | |
| 5,274,055 | A | 12/1993 | Honig et al. | |
| 5,340,865 | A | 8/1994 | Neff et al. | |
| 5,389,203 | A | 2/1995 | Sawayama et al. | |
| 5,393,381 | A | 2/1995 | Hund et al. | |

(Continued)

FOREIGN PATENT DOCUMENTS

EP 462365 A1 * 12/1991

(Continued)

OTHER PUBLICATIONS

Machine Translation of JP 2003-246909, published on Sep. 5, 2003.*

(Continued)

*Primary Examiner* — José A Fortuna
(74) *Attorney, Agent, or Firm* — Cantor Colburn LLP

(57) ABSTRACT

According to the present invention, a process is provided for making paper or board comprising forming a cellulosic suspension that may or may not comprise a filler, flocculating the cellulosic suspension, draining the cellulosic suspension on a screen to form a sheet, wherein the cellulosic suspension is flocculated using a flocculation system comprising the sequential or simultaneous addition of a siliceous material and an organic, cationic or anionic, water-in-water or dispersion micropolymer in a salt solution.

33 Claims, 13 Drawing Sheets

U.S. PATENT DOCUMENTS

| | | | | |
|---|---|---|---|---|
| 5,431,783 | A | 7/1995 | Honig | |
| 5,480,934 | A | 1/1996 | Messner et al. | |
| 5,501,774 | A | 3/1996 | Burke | |
| 5,597,858 | A | 1/1997 | Ramesh et al. | |
| 5,597,859 | A | 1/1997 | Hurlock et al. | |
| 5,882,525 | A | 3/1999 | Neff et al. | |
| 5,958,188 | A | 9/1999 | Heard et al. | |
| 6,007,679 | A * | 12/1999 | Nagarajan et al. | 162/168.3 |
| 6,310,157 | B1 | 10/2001 | Heard et al. | |
| 6,391,156 | B1 | 5/2002 | Hjalmarson et al. | |
| 6,395,134 | B1 * | 5/2002 | Chen et al. | 162/168.1 |
| 6,432,271 | B1 * | 8/2002 | Wong Shing et al. | 162/168.3 |
| 6,454,902 | B1 | 9/2002 | Chen | |
| 6,524,439 | B2 | 2/2003 | Chen et al. | |
| 6,605,674 | B1 | 8/2003 | Whipple et al. | |
| 6,616,806 | B2 | 9/2003 | I Chen | |
| 7,250,448 | B2 * | 7/2007 | Walchuk et al. | 516/20 |
| 7,507,781 | B2 * | 3/2009 | Walchuk et al. | 526/81 |
| 2002/0066540 | A1 * | 6/2002 | Chen et al. | 162/17 |
| 2004/0034145 | A1 * | 2/2004 | Fischer et al. | 524/457 |
| 2006/0000568 | A1 * | 1/2006 | Polverari et al. | 162/158 |
| 2006/0142430 | A1 * | 6/2006 | Harrington et al. | 524/13 |
| 2006/0142431 | A1 * | 6/2006 | Sutman et al. | 524/13 |
| 2006/0254464 | A1 * | 11/2006 | Nyander et al. | 106/600 |
| 2006/0289136 | A1 * | 12/2006 | Doherty et al. | 162/158 |
| 2006/0289137 | A1 * | 12/2006 | Gelman et al. | 162/168.3 |
| 2008/0066880 | A1 * | 3/2008 | Polverari et al. | 162/158 |
| 2008/0128102 | A1 * | 6/2008 | Polverari et al. | 162/168.3 |
| 2009/0188640 | A1 * | 7/2009 | Harrington | 162/175 |
| 2009/0211719 | A1 * | 8/2009 | Sutman et al. | 162/164.6 |

FOREIGN PATENT DOCUMENTS

| | | | |
|---|---|---|---|
| EP | 484617 | A1 * | 5/1992 |
| EP | 0624617 | | 11/1994 |
| EP | 0664302 | | 7/1995 |
| EP | 0674678 | | 3/1999 |
| JP | 2003246909 | A * | 9/2003 |
| JP | 20033246909 | | 9/2003 |
| WO | 97/18351 | | 5/1997 |
| WO | 98/24973 | | 6/1998 |
| WO | 2004029360 | A1 | 4/2004 |
| WO | WO 2008033490 | A1 * | 3/2008 |

OTHER PUBLICATIONS

European Patent Office, PCT International Search Report and Written Opinion, 13 pp., Feb. 6, 2008.
Harris, Neil et al., "Decoupling—The Latest Developments in Retention and Drainage Technology", African Pulp and Paper Week 2004; http://www.tappsa.co.za/archive2/APPW_2004/Title2004/Decoupling/decoupling.html; Sep. 1, 2006.
U.S. Appl. No. 11/531,911, filed Sep. 14, 2006.
EP 0624617, Publication date: Nov. 17, 1994, Abstract, 1 page.
EP 0664302, Publication date: Jul. 26, 1995, Abstract, 1 page.
EP 0674678, Publication date: Mar. 10, 1999, Abstract, 6 pages.
U.S. Appl. No. 11/531,911 Advisory Action dated: Mar. 17, 2010, 3 pages.
U.S. Appl. No. 11/531,911 Final Office Action dated: Jan. 14, 2010, 10 pages.
U.S. Appl. No. 11/531,911 Non-Final Office Action dated: Jan. 8, 2009, 70 pages.
U.S. Appl. No. 11/531,911 Non-Final Office Action dated: Jul. 21, 2010, 9 pages.
U.S. Appl. No. 11/531,911 Non-Final Office Action dated: Aug. 21, 2009, 51 pages.
JP1997078487A; Mar. 25, 1997; Machine Translation (9 pages).
JP1996059740A; Mar. 5, 1996; Machine Translation (27 pages).
JP1996060592A; Mar. 5, 1996; Machine Translation (20 pages).

* cited by examiner

COMPOSITION AND METHOD FOR PAPER PROCESSING

CROSS-REFERENCE TO RELATED APPLICATION

This application claims the benefit of U.S. application Ser. No. 11/531,911, filed Sep. 14, 2006, which is incorporated herein by reference in its entirety.

BACKGROUND

This invention relates to processes for making paper and paperboard from a cellulosic stock, employing a novel flocculation system in which a new micropolymer technology is employed.

During the manufacture of paper and paperboard, a cellulosic thin stock is drained on a moving screen (often referred to as a machine wire) to form a sheet, which is then dried. It is well known to apply water-soluble polymers to the cellulosic suspension in order to effect flocculation of the cellulosic solids and enhance drainage on the moving screen.

In order to increase output of paper, many modern papermaking machines operate at higher speeds. As a consequence of increased machine speeds, a great deal of emphasis has been placed on drainage and retention systems that provide increased drainage and retention of the papermaking components. It is known that increasing the molecular weight of a polymeric retention aid (which is generally added immediately prior to drainage) will tend to increase the rate of drainage, but will also damage formation. It can be difficult to obtain the optimum balance of retention, drainage, drying and formation by adding a single polymeric retention aid, and it is therefore common practice to add two separate materials in sequence or jointly.

More recent attempts to improve drainage and retention during papermaking have used variations on this theme by using different polymers and siliceous components. These systems can consist of multiple components.

U.S. Pat. No. 4,968,435 describes a method of flocculating an aqueous dispersion of suspended solids which comprises adding to, and mixing with the dispersion, from 0.1 to 50,000 parts per million of dispersion, solids of an aqueous solution of a water-insoluble, crosslinked, cationic, polymeric flocculent having an unswollen number average particle size diameter of less than 0.5 micrometers, a solution viscosity of 1.2 to 1.8 centipoise, and a crosslinking agent content above 4 molar parts per million, based on the monomeric units present in the polymer, to flocculate the suspended solids, and separating the flocculated suspended solids from the dispersion.

U.S. Pat. No. 5,152,903 is a continuation of this patent, and describes a method of flocculating a dispersion of suspended solids that comprises adding to, and mixing with the dispersion, from 0.1 to 50,000 parts per million of dispersion solids of an aqueous solution of a water-soluble, crosslinked, cationic, polymeric flocculent having an unswollen number average particle size diameter of less than 0.5 micrometers, a solution viscosity of from 1.2 to 1.8 centipoise and a crosslinking agent content above 4 molar parts per million based on the monomeric units present in the polymer.

U.S. Pat. No. 5,167,766 further describes a method of making paper which comprises adding to an aqueous paper furnish from 0.05 to 20 pounds per ton, based on the dry weight of paper furnish solids, of an ionic, organic, crosslinked polymeric microbead, the microbead having an unswollen particle diameter of less than 750 nanometers and an ionicity of at least 1%, but at least 5%, if anionic and used alone.

U.S. Pat. No. 5,171,808 is a further example which describes a composition comprising crosslinked anionic or amphoteric polymeric micropolymers derived solely from the polymerization of an aqueous solution of at least one monomer, the micropolymers having an unswollen number average particle size diameter of less than 0.75 micrometers, a solution viscosity of at least 1.1 centipoise, a crosslinking agent content of 4 molar parts to 4000 parts per million, based on the monomeric units present in the polymer, and an ionicity of at least 5 mole percent.

U.S. Pat. No. 5,274,055 describes a papermaking process wherein improved drainage and retention are obtained when ionic, organic microbeads, of less than 1,000 nanometers in diameter if crosslinked or less than 60 nanometers in diameter if non crosslinked, are added either alone or in combination with a high molecular weight organic polymer and/or polysaccharide. Further addition of alum enhances drainage formation and retention properties in papermaking stock with and without the presence of other additives used in papermaking processes.

U.S. Pat. No. 5,340,865 describes a flocculant comprising a water-in-oil emulsion comprising an oil phase and an aqueous phase wherein the oil phase consists of fuel oil, kerosene, odorless mineral spirits or mixtures thereof, and one more surfactants at an overall HLB ranging from 8 to 11, wherein the aqueous phase is in the form of micelles and contains a crosslinked, cationic, polymer produced from 40 to 99 parts by weight of acrylamide and 1 to 60 parts by weight of a cationic monomer selected from N,N-dialkylaminoalkylacrylates and methacrylates, and their quaternary or acid salts, N,N-dialkylaminoalkylacrylamides and methacrylamides, and their quaternary or acid salts, and dialkyldimethylammonium salts. The micelles have a diameter of less than 0.1 micrometers, and the polymer has a solution viscosity of from 1.2 to 1.8 centipoise, and a content of N,N-methylenebisacrylamide of 10 molar parts to 1000 molar parts per million, based on the monomeric units present in the polymer.

U.S. Pat. No. 5,393,381 describes a process of making paper or board by adding a water-soluble branched cationic polyacrylamide and a bentonite to the fibrous suspension of pulp. The branched cationic polyacrylamide is prepared by polymerizing a mixture of acrylamide, cationic monomer, branching agent, and chain transfer agent by solution polymerization.

U.S. Pat. No. 5,431,783 describes a method for providing improved liquid-solid separation performance in liquid particulate dispersion systems. The method comprises adding to a liquid system containing a plurality of finely divided particles from 0.05 to 10 pounds per ton, based upon the dry weight of the particles, of an ionic, organic crosslinked polymeric microbead with a diameter of less than 500 nanometers, and from 0.05 to 20 pounds per ton, on the same basis, of a polymeric material selected from the group consisting of polyethylenimines, modified polyethylenimines, and mixtures thereof. In addition to the compositions described above, additives such as organic ionic polysaccharides may also be combined with the liquid system to facilitate separation of the particulate material therefrom.

U.S. Pat. No. 5,501,774 describes a process where filled paper is made by providing an aqueous feed suspension containing filler and cellulosic fiber, coagulating the fiber and filler in the suspension by adding cationic coagulating agent, making an aqueous thinstock suspension by diluting a thickstock consisting of or formed from the coagulated feed suspension, adding anionic particulate material to the thinstock or to the thickstock from which the thinstock is formed, subsequently adding polymeric retention aid to the thinstock and draining the thinstock for form a sheet and drying the sheet.

U.S. Pat. No. 5,882,525 describes a process in which a cationic branched water-soluble polymer with a solubility quotient greater than 30% is applied to a dispersion of suspended solids, e.g. a paper making stock, in order to release water. The cationic, branched, water-soluble polymer is prepared from similar ingredients to U.S. Pat. No. 5,393,381, by polymerizing a mixture of acrylamide, cationic monomer, branching agent and chain transfer agent.

U.S. Pat. No. 4,913,775 describes a process wherein paper or paperboard is made by forming an aqueous cellulosic suspension, passing the suspension through one or more shear stages selected from cleaning, mixing and pumping, draining the suspension to form a sheet, and drying the sheet. The suspension that is drained includes an organic polymeric material that is a flocculant or a retention aid, and an inorganic material comprising bentonite, which is added in an amount of at least 0.03% to the suspension after one of the shear stages. The organic polymeric retention aid or flocculant comprises a substantially linear synthetic cationic polymer having molecular weight above 500,000 and having a charge density of at least 0.2 equivalents of nitrogen per kilogram of polymer. The organic polymeric retention aid or flocculant is added to the suspension before the shear stage in an amount such that flocs are formed. The flocs are broken by the shearing to form microflocs that resist further degradation by the shearing, and that carry sufficient cationic charge to interact with the bentonite to give better retention than that which is obtainable when adding the polymer alone after the last point of high shear. This process is commercialized by Ciba Specialty Chemicals under the Hydrocol registered trademark.

U.S. Pat. No. 5,958,188 further describes a process where paper is made by a dual soluble polymer process in which a cellulosic suspension, which usually contains alum or cationic coagulant, is first flocculated with a high intrinsic viscosity (IV) cationic synthetic polymer or cationic starch and, after shearing, the suspension is reflocculated by the addition of a branched anionic water-soluble polymer having an intrinsic viscosity above 3 deciliters per gram, and a tan delta at 0.005 Hertz of at least 0.5.

U.S. Pat. No. 6,310,157 describes a dual soluble polymer process in which a cellulosic suspension which usually contains alum or cationic coagulant is first flocculated with a high IV cationic synthetic polymer or cationic starch and, after shearing, the suspension is reflocculated by the addition of a branched anionic water-soluble polymer having IV above 3 dl/g and tan delta at 0.005 Hz of at least 0.5. The process gives an improved combination of formation, retention, and drainage.

U.S. Pat. No. 6,391,156 describes a process of making paper or paper board comprising forming a cellulosic suspension, flocculating the suspension, draining the suspension on a screen to form a sheet and then drying the sheet, characterized in that the suspension is flocculated using a flocculation system comprising a clay and an anionic branched water-soluble polymer that has been formed from water-soluble ethylenically unsaturated anionic monomer or monomer blend and branching agent and wherein the polymer has an (a) intrinsic viscosity above 1.5 dl/g and/or saline Brookfield viscosity of above 2.0 mPa·s and (b) rheological oscillation value of tan delta at 0.005 Hz of above 0.7 and/or (c) deionised SLV viscosity number which is at least three times the salted SLV viscosity number of the corresponding unbranched polymer made in the absence of branching agent.

U.S. Pat. No. 6,454,902 describes a process for making paper comprising forming a cellulosic suspension, flocculating the suspension, draining the suspension on a screen to form a sheet, and then drying the sheet, wherein the cellulosic suspension is flocculated by addition of a polysaccharide or a synthetic polymer of intrinsic viscosity at least 4 deciliters per gram, and then reflocculated by a subsequent addition of a reflocculating system, wherein the reflocculation system comprises a siliceous material and a water-soluble polymer. In one embodiment, the siliceous material is added prior to or simultaneously with the water-soluble polymer. In another embodiment, the water-soluble polymer is anionic and added prior to the siliceous material.

U.S. Pat. No. 6,524,439 provides a process for making paper or paperboard comprising forming a cellulosic suspension, flocculating the suspension, draining the suspension on a screen to form a sheet and then drying the sheet. The process is characterized in that the suspension is flocculated using a flocculation system comprising a siliceous material and organic microparticles that have an unswollen particle diameter of less than 750 nanometers.

U.S. Pat. No. 6,616,806 describes a process for making paper comprising forming a cellulosic suspension, flocculating the suspension, draining the suspension on a screen to form a sheet and then drying the sheet, wherein the cellulosic suspension is flocculated by addition of a water-soluble polymer which is selected from a) a polysaccharide or b) a synthetic polymer of intrinsic viscosity at least 4 dl/g and then reflocculated by a subsequent addition of a reflocculating system, wherein the reflocculating system comprises i) a siliceous material and ii) a water-soluble polymer. In one aspect the siliceous material is added prior to or simultaneous with the water-soluble polymer. In an alternative for the water-soluble polymer is anionic and added prior to the siliceous material.

JP Publication No. 2003-246909 discloses polymer dispersions is produced by combining an amphoteric polymer having a specific cationic structural unit and an anionic structural unit and soluble in the salt solution, and a specific anionic polymer soluble in the salt solution and polymerizing them in dispersion under agitation in the salt solution.

However, there still exists a need to further enhance paper making processes by further improving drainage, retention and formation. Furthermore there also exists a need for providing a more effective flocculation system for making highly filled paper. It would be desirable if these improvements included use of polymers that require less make-down equipment, less complicated feed-systems, and environmentally friendly, e.g., polymers with low or no volatile organic chemicals (VOC).

SUMMARY

The above-described drawbacks and disadvantages are alleviated by a process for making paper or paperboard, comprising: forming a cellulosic suspension; flocculating the cellulosic suspension; draining the cellulosic suspension on a screen to form a sheet; and drying the sheet; wherein the cellulosic suspension is flocculated by adding a flocculation system comprising a siliceous material and an organic, anionic or cationic, water-in-water or salt dispersion micropolymer, wherein the siliceous material and the organic micropolymer are added simultaneously or sequentially. It has been found that the water-in-water or salt dispersion micropolymers offer significant advantages over a micropolymer emulsion not in the form of a water-in-water or salt dispersion of the micropolymer.

In another embodiment, a paper or paperboard is provided, made by the above process.

Further advantages of the invention are described and exemplified in the following Figures and Detailed Description.

DETAILED DESCRIPTION

Figure 1:
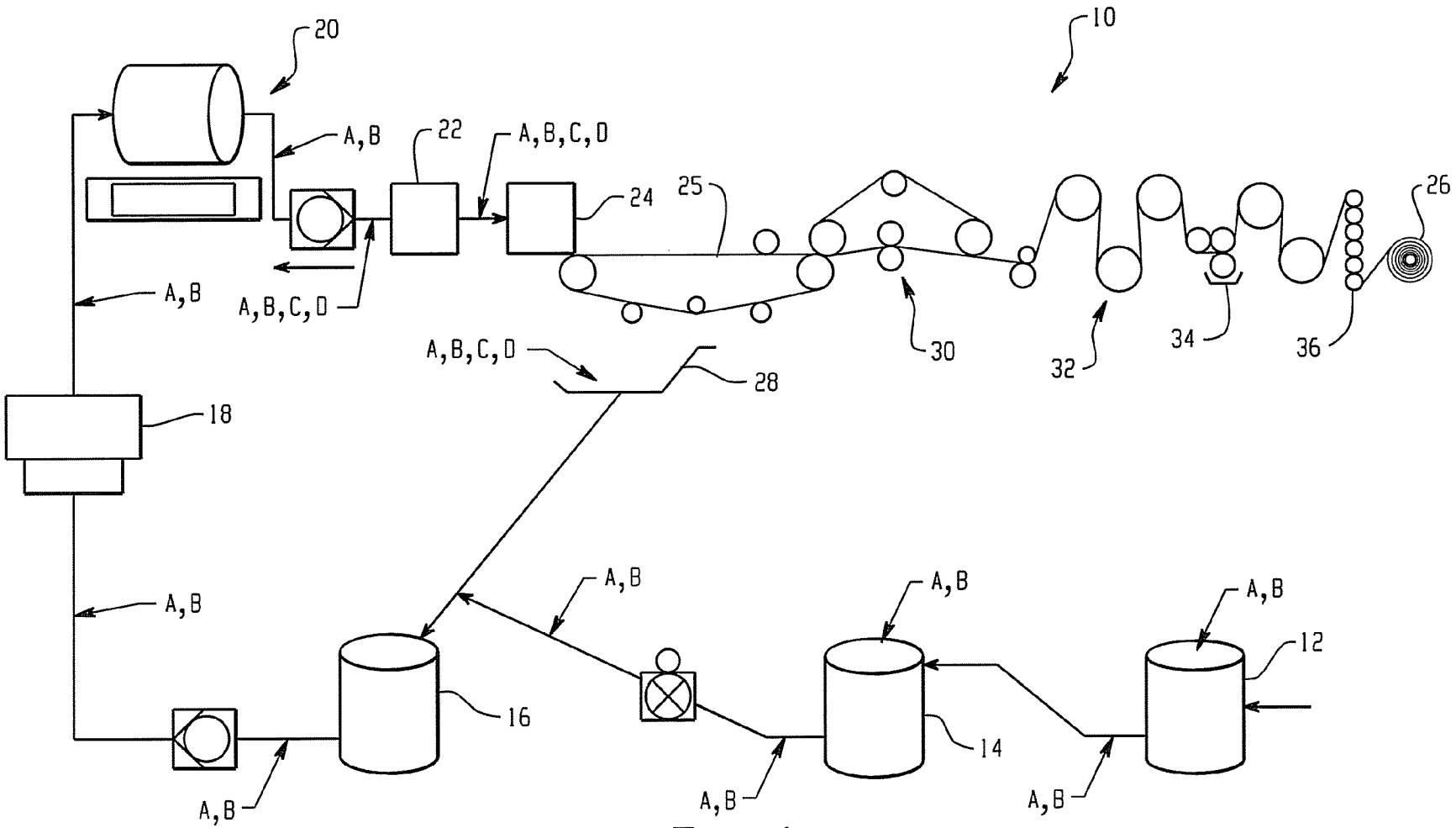
FIG. 1 is a schematic diagram of a papermaking process illustrating where the components of the flocculating systems can be added in the paper and paperboard making process.

The inventors hereof have unexpectedly discovered that in the manufacture of paper or paperboard products, flocculation is significantly improved by use of a water-in-water micropolymer or a salt dispersion micropolymer in combination with a siliceous material. The micropolymer is organic, and can be cationic or anionic. Use of this flocculation system provides improvements in retention, drainage, and formation compared to a system without the siliceous material, or a system where the micropolymer is not in the form of a water-in-water or salt dispersion micropolymer.

As is known in the art, micropolymers can be provided in at least three different forms: emulsion, dispersion, and water-in-water.

Emulsion micropolymers are manufactured by a polymerization process wherein the reaction occurs in the presence of a small amount of water and an organic solvent, usually oil, as a continuous phase. The reactant monomers, but not the product polymers are soluble in the organic solvent. As the reaction proceeds and the product polymer chain length grows, it migrates to the small water droplets and concentrates within these water droplets. The viscosity of the final product is low, and the resultant polymer is typically of very high molecular weight. When the emulsion is mixed with additional water, the polymer inverts (the water becomes the continuous phase) and the solution viscosity becomes very high. Polymers of this type can be anionic or cationic.

Dispersion micropolymers are made by a precipitation polymerization process in which a salt solution acts as both the continuous phase and as a coagulant. Thus, polymerization occurs in a salt solution in which the monomers are soluble, but not the product polymers. Because the polymer is insoluble in the salt solution, it precipitates as discrete particles, which are kept suspended using appropriate stabilizers. The final viscosity of the product is low, enabling ease of handling. The process produces well-defined particles containing polymers of high molecular weight. There are no surfactants or organic solvents (particularly oils) present and the polymers are solubilized by simple mixing with water. Polymers of this type can be anionic or cationic. The inorganic salt (the coagulant) and high molecular weight polymer interact synergistically. The system can be amphoteric, meaning that when the high molecular weight polymer is anionic, the inorganic, mineral coagulant is cationic. Preferably the high molecular weight polymer is also hydrophobically associative. References describing these types of polymers include U.S. Pat. Nos. 6,605,674, 4,929,655, 5,006,590, 5,597,859, and 5,597,858.

Water-in-water micropolymers are made by a polymerization process in which the reaction occurs in a water-organic coagulant mixture (typically 50:50), in which both the monomers and product micropolymers are soluble. Exemplary organic coagulants include certain polyamines such as polyDADMAC or polyDIMAPA. The viscosity of the final product is high but lower than solution polymers and the resultant polymer is typically of very high molecular weight. The water-organic coagulant solvent system serves as a viscosity depressor and coagulant. There are no surfactants or organic solvents (oils) present, and the resultant 2-in-1 polymers are solubilized by simple mixing with water. The final product can be considered to be like a high molecular weight polymer dissolved in the organic liquid coagulant. The low molecular weight organic polymer is the continuous phase and a coagulant. The organic coagulant and high molecular weight polymer interact synergistically. Polymers of this type are usually cationic and hydrophobically associative. Preferably the high molecular weight polymer is hydrophobically associative also. The micropolymers as used herein can be referred to as "solventless," in that no low molecular weight organic solvent (i.e., no oil) is present. References describing these types of polymers include U.S. Pat. No. 5,480,934 and U.S. Publ. No. 2004/0034145.

Thus, in accordance with the present disclosure, a process is provided for making paper or paperboard, comprising forming a cellulosic suspension, flocculating the cellulosic suspension, draining the cellulosic suspension on a screen to form a sheet, and then drying the sheet, wherein the cellulosic suspension is flocculated by adding a flocculation system comprising an organic, anionic or cationic micropolymer, and a siliceous material, added simultaneously or sequentially. The micropolymer is in the form of water-in-water or salt dispersion micropolymer. The micropolymer solution as a reduced viscosity of greater than or equal to 0.2 deciliters per gram, more specifically greater than or equal to 4 deciliters per gram.

In an specific exemplary embodiment, the process by which paper or paperboard is made comprises forming an aqueous cellulosic suspension, passing the aqueous cellulosic suspension through one or more shear stages selected from cleaning, mixing, pumping, and combinations thereof, draining the cellulosic suspension to form a sheet, and drying the sheet. The drained cellulosic suspension used to form the sheet comprises a cellulosic suspension that is flocculated with an organic, water-in-water or salt dispersion micropolymer, and an inorganic siliceous material, which are added, simultaneously or sequentially, in an amount of at least 0.01 percent by weight, based on the total weight of the dry cellulosic suspension, to the cellulosic suspension after one of the shear stages. In addition, the drained cellulosic suspension used to form the sheet comprises an organic polymeric retention aid or flocculant comprising a substantially linear synthetic cationic, non ionic, or anionic polymer having a molecular weight greater than or equal to 500,000 atomic mass units that is added to the cellulosic suspension before the shear stage in an amount such that flocs are formed by the addition of the polymer, and the flocs are broken by the shearing to form microflocs that resist further degradation by the shearing and that carry sufficient anionic or cationic charge to interact with the siliceous material and organic micropolymer to give better retention than the retention that is obtainable when adding the organic micropolymer alone after the last point of high shear.

In some embodiments, one or more shear stages comprise a centriscreen. The polymer is added to the cellulosic suspension before the centriscreen, and the flocculation system (micropolymer/siliceous material) is added after the centriscreen.

In another embodiment one or more shear stages, such as a centriscreen, can be between the application of the flocculation system of micropolymer and the siliceous material. The siliceous material is applied before one or more shear stages and the organic micropolymer is applied after the last shear point. Application of a substantially linear synthetic polymer of either cationic, anionic or non ionic charge is applied before the siliceous material but it is generally preferred that it is applied after the last shear point either before the organic micropolymer or concurrently with the organic micropolymer.

In another embodiment one or more shear stages, such as a centriscreen, can be between the application of the flocculation system of micropolymer and the siliceous material. The organic micropolymer is applied before one or more shear stages and the siliceous material is applied after the last shear point. Application of a substantially linear synthetic polymer of either cationic, anionic or non ionic charge is applied before the siliceous material preferably before one or more shear points, which can include concurrent application with the organic micropolymer.

At a minimum, the flocculation system disclosed herein comprises an organic, anionic or cationic, water-in-water or salt dispersion micropolymer solution in combination with a siliceous material. As described above, such micropolymers contain either a low molecular weight organic coagulant or an inorganic salt coagulant. These micropolymer dispersions (both organic and coagulant and inorganic salt coagulant) can also be referred to as referred to as "solventless," in that no low molecular weight organic solvent (i.e., no oil) is present. Thus, both types of the micropolymer dispersions are substantially free of volatile organic compound (VOC)s and alkylphenol ethoxylate (APE). In one embodiment the dispersions are free of VOCs and APE. The organic micropolymers can be a mixture of linear polymers and/or short-chain branched polymers. An aqueous solution of the organic micropolymer has a reduced viscosity greater than or equal to 0.2 deciliters per gram (dl/g), specifically greater than or equal to 4 dl/g. The organic micropolymers exhibit a solution viscosity of greater than or equal to 0.5 centipoise (millipascal-second) and have an ionicity of greater than or equal to 5.0 percent. They are liquid, aqueous, cationic or anionic polymers with typical charge densities of between 5 and 75% mole percent, a solids content between 2 and 70%, and viscosities in water at 1% of between 10 and 20,000 mPa sec. In one advantageous feature, the micropolymers of the organic water-in-water dispersions are hydrophobically associated. In another embodiment, the micropolymers of the salt dispersions are hydrophobically associated. Without being bound by theory, it is believed that these associations or interactions build a very highly structured polymer, creating a three dimensional micro-network wherein the polymer particles in either type of dispersion is estimated to be 10 to 150 nanometers (nm), specifically 10 to 100 nm, more specifically about 50 nm in size, as determined by Zimm analysis. Because the structure is created without chemically cross-linking the polymer constituents, the charge of the polymer is very accessible, increasing reactivity. Thus, in one embodiment, the micropolymers are not chemically crosslinked. In another embodiment, the micropolymers are highly structured polymers demonstrating very little linearity. In still another embodiment, the anionic polymers, in particular of the organic water-in-water dispersions, can have a tan delta at 0.005 Hz above 0.7 and a delta value above 0.5. In still another embodiment, the anionic polymers, in particular of the inorganic salt dispersions, can have a tan delta at 0.005 Hz above 0.7 and a delta value above 0.5. Synthesis of some suitable polymers is described in U.S. Pat. No. 5,480,934, EP No. 0 664302 B1, EP No. 0 674678 B1, and EP No. 624617 B1.

In one general procedure, a suitable micropolymer can be prepared by initiating polymerization of an aqueous mixture of monomers in an inorganic mineral coagulant salt or an organic coagulant solution to form an organic micropolymer. In particular, the organic micropolymer is prepared by polymerizing a monomer mixture containing at least 2 mole percent of a cationic or anionic monomer in an aqueous solution of a polyvalent ionic salt or a low molecular weight organic coagulant. The polymerization is carried out in an aqueous solution that can comprise 1 to 30 percent by weight, based on the total weight of the monomers, of a dispersant polymer, the dispersant polymer being a water-soluble anionic or cationic polymer which is soluble in the aqueous solution of the polyvalent ionic salt or organic coagulant.

The polyvalent ionic coagulant salt can be a phosphate, a nitrate, sulfate a halide, e.g., chloride, or a combinations thereof, in particular aluminum sulfate and polyaluminum chloride (PAC). The low molecular weight organic coagulant has an intrinsic viscosity below 4 dl/g, and one or more functional groups such as ether, hydroxyl, carboxyl, sulfone, sulfate ester-, amino, amido, imino, tertiary-amino and/or quaternary ammonium groups. The organic coagulant can be a polyamine such as polyethyleneimine, polyvinylamine, poly(DADMAC), and poly(DIMAPA), amongst others.

The polymerizable monomers are ethylenically unsaturated, and can be selected from the group consisting of acrylamide, methacrylamide, diallyldimethylammonium chloride, dimethylaminoethyl acrylate methyl chloride quaternary salt, dimethylaminoethyl methacrylate methyl chloride quaternary salt, acrylamidopropyltrimethylammonium chloride, methacrylamidoproplytrimethylammonium chloride, acrylic acid, sodium acrylate, methacrylic acid, sodium methacrylate, ammonium methacrylate, and the like, and a combination comprising at least one of the foregoing monomers.

In a specific embodiment, as set forth in U.S. Pat. No. 5,480,934, a low-viscosity, water-soluble high molecular weight water-in-water polymeric dispersion is prepared by (i)

polymerizing a composition comprising 99 to 70 weight % of a water-soluble monomer (a1), from 1 to 30 weight % of a hydrophobic monomer (a2) and, optionally from 0 to 20 weight %, preferably 0.1 to 15 weight % of an amphiphilic monomer (a3), in the presence of at least one polymeric dispersing agent (D) thereby preparing a dispersion of polymer (A); and a second step (ii) of adding at least one polymeric dispersion agent (D), in an aqueous solution, to the dispersion.

The water-soluble monomer (a1) can be sodium (meth) acrylate, potassium (meth)acrylate, ammonium (meth)acrylate, and the like, as well as acrylic acid, methacrylic acid, and/or (meth)acrylic amides such as (meth)acrylic amide, N-methyl(meth)acrylic amide, N,N-dimethyl(meth)acrylic amide, N,N-diethyl(meth)acrylic amide, N-methyl-N-ethyl (meth)acrylic amide, and N-hydroxyethyl(meth)acrylic amide. Still other specific examples of monomers of type (a1) include 2-(N,N-dimethylamino)ethyl (meth)acrylate, 3-(N,N-dimethylamino)propyl (meth)acrylate, 4-(N,N-dimethylamino)butyl (meth)acrylate, 2-(N,N-diethylamino)ethyl (meth)acrylate, 2-hydroxy-3-(N,N-dimethylamino)propyl (meth)acrylate, 2-(N,N,N-trimethyl ammonium)ethyl (meth) acrylate chloride, 3-(N,N,N-trimethylammonium)propyl (meth)acrylate chloride and 2-hydroxyl-3-(N,N,N-trimethylammonium)propyl (meth)acrylate chloride, 2-dimethylaminoethyl(meth)acrylic amide, 3-dimethylaminopropyl(meth) acrylic amide, and 3-trimethylammoniumpropyl (meth) acrylic amide chloride. Monomer components (a1) also include ethylenically unsaturated monomers that are capable of producing water-soluble polymers such as vinylpyridine, N-vinylpyrrolidone, styrenesulfonic acid, N-vinylimidazole, diallyldimethylammonium chloride, and the like. Combinations of different water-soluble monomers, listed under (a1) are also possible. To produce the (meth)acrylic amides, see for example, Kirk-Othmer, Encyclopedia of Chemical Technology, vol. 15, pages 346 to 276, 3d edition, Wiley Interscience, 1981. For the preparation of (meth)acrylic ammonium salts see, for example, Kirk-Othmer, Encyclopedia of Chemical Technology, vol. 15, pages 346 to 376, Wiley Interscience, 1987.

Exemplary hydrophobic monomers (a2) include ethylenically unsaturated compounds such as styrene, alpha-methyl styrene, p-methylstyrene, p-vinyltoluene, vinylcyclopentane, vinylcyclohexane, vinylcyclooctane, isobutene, 2-methylbutene-1, hexene-1,2-methylhexene-1,2-propylhexene-1, ethyl (meth)acrylate, propyl (meth)acrylate, isopropyl (meth) acrylate, butyl (meth)acrylate, isobutyl (meth)acrylate, pentyl (meth)acrylate, hexyl (meth)acrylate, heptyl (meth)acrylate, octyl (meth)acrylate, cyclopentyl (meth)acrylate, cyclohexyl (meth)acrylate, 3,3,5-trimethylcyclohexyl (meth) acrylate, cyclooctyl (meth)acrylate, phenyl (meth)acrylate, 4-methylphenyl (meth)acrylate, 4-methoxyphenyl (meth) acrylate, and the like. Other hydrophobic monomers (a2) include ethylene, vinylidene chloride, vinylidene fluoride, vinyl chloride or other mainly (aryl)aliphatic compounds having polymerizable double bonds. Combinations of different hydrophobic monomers (a2) can be used.

The optional amphiphilic monomer (a3) is a copolymerizable ethylenically unsaturated compound, e.g., an acrylate or methacrylate comprising a hydrophilic group, e.g., a hydroxyl group, a polyethylene ether group, or a quaternary ammonium group, and a hydrophobic group, e.g., a $C_{8-32}$ alkyl, aryl, or arylalkyl group. In order to produce the amphiphilic monomers (a3) see, for example, Kirk-Othmer, Encyclopedia of Chemical Technology, vol. 1, 3d ed., pages 330 to 354 (1978) and vol. 15, pages 346 to 376 (1981), Wiley Interscience. Combinations of different amphiphilic monomers (a3) are possible.

Exemplary polymeric dispersing agents (D) are polyelectrolytes with an average molecular weight (mean weight, $M_W$) of less than $5\cdot10^5$ Dalton, or polyalkylene ethers that are incompatible with the dispersed polymer (A). The polymeric dispersing agent (D) is significantly different in its chemical composition and in its average molecular weight $M_W$ from the water-soluble polymer that consists of the monomeric mix (A). The average molecular weights $M_W$ of the polymeric dispersing agents range between $10^3$ to $5\cdot10^5$ Dalton, preferably between $10^4$ to $4\cdot10^5$ Dalton (to determine $M_W$, see H. F. Mark et al., Encyclopedia of Polymer Science and Technology, vol. 10, pages 1 through 19, J. Wiley, 1987).

The polymeric dispersing agents (D) contain at least one functional group selected from the group consisting of ether-, hydroxyl-, carboxyl-, sulfone-, sulfate ester-, amino-, amido-, imino-, tertiary-amino- and/or quaternary ammonium groups. Exemplary polymeric dispersing agents (D) include cellulose derivatives, polyethylene glycol, polypropylene glycol, copolymers from ethylene glycol and propylene glycol, polyvinyl acetate, polyvinyl alcohol, starch and starch derivatives, dextran, polyvinyl pyrrolidone, polyvinyl pyridine, polyethyleneimine, polyvinyl imidazole, polyvinyl succinimide, polyvinyl-2-methyl succinimide, polyvinyl-1,3-oxazolidone-2, polyvinyl-2-methyl imidazoline, as well as copolymers which, apart from the combinations of monomeric units of the above mentioned polymers, can contain the following monomer units: maleic acid, maleic anhydride, fumaric acid, itaconic acid, itaconic anhydride, (meth)acrylic acid, salts of (meth)acrylic acid or (meth)acrylic amide compounds.

Specific polymeric dispersing agents (D) include polyalkylene ethers such as polyethylene glycol, polypropylene glycol, or polybutylene-1,4-ether. For the production of polyalkylene ethers see, for example, Kirk-Othmer, Encyclopedia of Chemical Technology, 3d ed., vol. 18, pages 616 to 670, 1982, Wiley Interscience. Especially suitable polymeric dispersing agents (D) include polyelectrolytes such as polymers that contain monomer units such as salts of (meth)acrylic acid, anionic monomer units or derivatives quaternated with methyl chloride such as N,N-dimethylaminoethyl(meth) acrylate, N,N-dimethylaminopropyl(meth)acrylate N,N-dimethylaminohydroxypropyl(meth)acrylate amide and N,N-dimethylaminopropyl(meth)acrylic amide. Especially suitable as a polymeric dispersing agent is poly(diallyldimethylammonium chloride) (poly-DADMAC) with an average molecular weight $M_W$ between $5\cdot10^4$ and $4\cdot10^5$ Dalton. For the production of polyelectrolytes see, for example, Kirk-Othmer, Encyclopedia of Chemical Technology, 3d ed., vol. 18, pages 495 to 530, 1982, Wiley Interscience. Furthermore, low molecular emulsifying agents having a molecular weight of less than $10^3$ Dalton in quantities of 0 to 5 weight % based on the polymer dispersion can be used.

These and other solventless polymers are included in the scope of the present invention, regardless of the number, types, or concentration of monomers. The present invention also includes cationic and anionic organic micropolymers that have been dried to form a powder.

The siliceous material is an anionic microparticulate or nanoparticulate silica-based material. The siliceous material is selected from the group consisting of hectorite, smectites, montmorillonites, nontronites, saponite, sauconite, hormites, attapulgites, laponite, sepiolites, and the like. Combinations comprising at least one of the foregoing siliceous materials can be used. The siliceous material also can be any of the materials selected from the group consisting of silica based particles, silica microgels, colloidal silica, silica sols, silica gels, polysilicates, aluminosilicates, polyaluminosilicates, borosilicates, polyborosilicates, zeolites, swellable clay, and the like, and a combination of at least one of the foregoing siliceous materials. Bentonite-type clays can be used. The bentonite can be provided as an alkali metal bentonite, either in powder or slurry form. Bentonites occur naturally either as alkaline bentonites, such as sodium bentonite, or as the alkaline earth metal salt, such as the calcium or magnesium salt.

These components of the flocculation system are introduced into the cellulosic suspension either sequentially or simultaneously. Preferably, the siliceous material and the polymeric micropolymers are introduced simultaneously. When introduced simultaneously, the components can be kept separate before addition, or can be premixed. When introduced sequentially, the organic micropolymer is introduced into the cellulosic suspension before the siliceous material, when both the organic micropolymer and siliceous material are applied to the cellulosic suspension after the final shear stage.

In another embodiment, the flocculation system comprises three components, wherein the cellulosic suspension is pretreated by inclusion of a flocculant prior to introducing the organic micropolymer and siliceous material. The pretreatment flocculant can be anionic, nonionic, or cationic. It can be a synthetic or natural polymer, specifically a water-soluble, substantially linear or branched, organic polymer. For cationic synthetic water-soluble polymers, the polymer can be made from a water-soluble ethylenically unsaturated cationic monomer or blend of monomers wherein at least one of the monomers in the blend is cationic or potentially cationic. A water-soluble monomer is a monomer having a solubility of at least 5 grams per 100 cubic centimeters of water. The cationic monomer is advantageously selected from diallyl dialkyl ammonium chlorides, acid addition salts or quaternary ammonium salts of either dialkyl aminoalkyl (meth) acrylate or dialkyl amino alkyl (meth)acrylamides. The cationic monomer can be polymerized alone or copolymerized with water-soluble non-ionic, cationic, or anionic monomers. It is advantageous for such polymers to have an intrinsic viscosity of at least 3 deciliters per gram. Specifically, up to 18 deciliters per gram. More specifically, from 7 up to 15 deciliters per gram. The water-soluble cationic polymer can also have a slightly branched structure by incorporating up to 20 parts per million by weight of a branching agent. For anionic synthetic water-soluble polymers, it may be made from a water-soluble monomer or monomer blend of which at least one monomer is anionic or potentially anionic. The anionic monomer may be polymerized alone or copolymerized with any other suitable monomer, such as any water-soluble nonionic monomer. The anionic monomer is preferably an ethylenically unsaturated carboxylic acid or sulphonic acid. Typical anionic polymers are made from acrylic acid or 2-acrylamido-2-methylpropane sulphonic acid. When the water-soluble polymer is anionic, it is a copolymer of acrylic acid (or salts thereof) with acrylamide. If the polymer is nonionic it may be any poly alkylene oxide or a vinyl addition polymer that is derived from any water-soluble nonionic monomer or blend of monomers. The typical water-soluble non ionic polymer is acrylamide homopolymer. The water-soluble organic polymers can be a natural polymer, such as cationic starch or synthetic cationic polymers such as polyamines, poly(diallyldimethylammonium chloride), polyamido amines, and polyethyleneimine. The pretreatment flocculant can also be a crosslinked polymer, or a blend of a crosslinked polymer and a water-soluble polymer. The pretreatment flocculant can also be an inorganic material such as alum, aluminum sulfate, polyaluminum chloride, silicated poly-aluminum chloride, aluminum chloride trihydrate and aluminum chlorohydrate, and the like.

Thus, in a specific embodiment of the paper or paperboard manufacturing process, the cellulosic suspension is first flocculated by introducing the pretreatment flocculant, then optionally subjected to mechanical shear, and then reflocculated by introducing the organic micropolymer and siliceous material simultaneously. Alternatively, the cellulosic suspension is reflocculated by introducing the siliceous material and then the organic micropolymer, or by introducing the organic micropolymer and then the siliceous material.

The pretreatment comprises incorporating the pretreatment flocculant into the cellulosic suspension at any point prior to the addition of the organic micropolymer and siliceous material. It can be advantageous to add the pretreatment flocculant before one of the mixing, screening, or cleaning stages, and in some instances before the stock cellulosic suspension is diluted. It can even be advantageous to add the pretreatment flocculant into the mixing chest or blend chest or even into one or more of the components of the cellulosic suspension, such as coated broke, or filler suspensions, such as precipitated calcium carbonate slurries.

In still another embodiment, the flocculation system comprises four flocculant components, the organic micropolymer and siliceous material, a water-soluble cationic flocculant, and an additional flocculent/coagulant that is an nonionic, anionic, or cationic water-soluble polymer.

In this embodiment, the water-soluble cationic flocculant can be organic, for example, water-soluble, substantially linear or branched polymers, either natural (e.g., cationic starch) or synthetic (e.g., polyamines, poly(diallyldimethylammonium chloride)s, polyamido amines, and polyethyleneimines). The water-soluble cationic flocculant can alternatively be an inorganic material such as alum, aluminum sulfate, polyaluminum chloride, silicated polyaluminum chloride, aluminum chloride trihydrate and aluminum chlorohydrate, and the like.

The water-soluble cationic flocculant is advantageously a water-soluble polymer, which can, for instance, be a relatively low molecular weight polymer of relatively high cationicity. For instance, the polymer can be a homopolymer of any suitable ethylenically unsaturated cationic monomers polymerized to provide a polymer with an intrinsic viscosity of up to 3 deciliters per gram. Homopolymers of diallyl dimethyl ammonium chloride are exemplary. The low molecular weight, high cationicity polymers can be addition polymers formed by condensation of amines with other suitable di- or trifunctional species. For example, the polymer can be formed by reacting one or more amines selected from dimethyl amine, trimethyl amine, ethylene diamine, epihalohydrin, epichlorohydrin, and the like, and a combination of at least one of the foregoing amines. It is advantageous for the cationic flocculant/coagulant to be a polymer that is formed from a water-soluble ethylenically unsaturated cationic monomer or blend of monomers wherein at least one of the monomers in the blend is cationic or potentially cationic. A water-soluble monomer is a monomer having a solubility of at least 5 grams per 100 cubic centimeters of water. The cationic monomer is advantageously selected from diallyl dialkyl ammonium chlorides, acid addition salts or quaternary ammonium salts of either dialkyl aminoalkyl (meth) acrylate or dialkyl amino allyl (meth)acrylamides. The cationic monomer can be polymerized alone or copolymerized with water-soluble non-ionic, cationic, or anionic monomers. It is advantageous for such polymers to have an intrinsic viscosity of at least 3 deciliters per gram. Specifically, up to 18 deciliters per gram. More specifically, from 7 up to 15 deciliters per gram. The water-soluble cationic polymer can also have a slightly branched structure by incorporating up to 20 parts per million by weight of a branching agent.

The additional flocculant/coagulant is a nonionic, amphoteric, anionic, or cationic, natural or synthetic, water-soluble polymer capable of causing flocculation/coagulation of the fibers and other components of the cellulosic suspension. The water-soluble polymer is a branched or linear polymer having an intrinsic viscosity greater than or equal to 2 dl/g. It can be a natural polymer such as natural starch, cationic starch, anionic starch, or amphoteric starch. Alternatively, it can be any water-soluble, synthetic polymer that preferably exhibits ionic character. For cationic polymers, the cationic polymer is comprised of free amine groups that become cationic once introduced into a cellulosic suspension with a sufficiently low pH so as to protonate free amine groups. It is advantageous for the cationic polymers to carry a permanent cationic charge, such as, for example, quaternary ammonium groups. The water-soluble polymer can be formed from a water-soluble ethylenically unsaturated monomer of which one monomer is at least cationic or potentially cationic, or a water-soluble blend of ethylenically unsaturated monomers comprising at least one type anionic or cationic monomers or potentially cationic or potentially anionic, producing an amphoteric polymer. For anionic synthetic water-soluble polymers, it may be made from a water-soluble monomer or monomer blend of which at least one monomer is anionic or potentially anionic. For nonionic water-soluble polymers, it may be any poly alkylene oxide or a vinyl addition polymer that is derived from any water-soluble nonionic monomer or blend of monomers.

The additional flocculant/coagulant component is preferably added prior to any one or more of the siliceous material, organic micropolymer, or water-soluble cationic flocculant.

In use, all of the components of the flocculation system can be added prior to a shear stage. It is advantageous for the last component of the flocculation system to be added to the cellulosic suspension at a point in the process where there is no substantial shearing before draining to form the sheet. Thus it is advantageous that at least one component of the flocculation system is added to the cellulosic suspension, and the flocculated cellulosic suspension is then subjected to mechanical shear wherein the flocs are mechanically degraded and then at least one component of the flocculation system is added to reflocculate the cellulosic suspension prior to draining.

In an exemplary embodiment, the first water-soluble cationic flocculant polymer is added to the cellulosic suspension and then the cellulosic suspension is mechanically sheared. The additional, higher molecular weight coagulant/flocculant can then be added and then the cellulosic suspension is sheared through a second shear point. The siliceous material and the organic micropolymer are added last to the cellulosic suspension.

The organic micropolymer and siliceous material can be added either as a premixed composition or separately but simultaneously, but they are advantageously added sequentially. Thus, the cellulosic suspension can be reflocculated by addition of the organic micropolymers followed by the siliceous material, but preferably the cellulosic suspension is reflocculated by adding siliceous material, and then the organic micropolymers.

The first component of the flocculation system can be added to the cellulosic suspension and then the flocculated cellulosic suspension can be passed through one or more shear stages. The second component of the flocculation system can be added to reflocculate the cellulosic suspension, and then the reflocculated suspension can be subjected to further mechanical shearing. The sheared reflocculated cellulosic suspension can also be further flocculated by addition of a third component of the flocculation system. In the case where the addition of the components of the flocculation system is separated by shear stages, it is advantageous that the organic micropolymer and the siliceous material are the last components to be added, at a point in the process where there will no longer be any shear.

In another embodiment, the cellulosic suspension is not subjected to any substantial shearing after addition of any of the components of the flocculation system to the cellulosic suspension. The siliceous material, organic micropolymer, and optionally, the coagulating material, can all be introduced into the cellulosic suspension after the last shear stage prior to draining. In such embodiments, the organic micropolymer can be the first component followed by either the coagulating material (if included), and then the siliceous material. However, other orders of addition can also be used, with all the components or just the siliceous material and the organic micropolymer being added. In one configuration, for example, one or more shear stages is between the application of the flocculation system of micropolymer and the siliceous material. For example, the siliceous material is applied before one or more shear stages and the organic micropolymer is applied after the last shear point. Application of a substantially linear synthetic polymer of cationic, anionic, or non ionic charge can be after the last shear point, either before the organic micropolymer or concurrently with the organic micropolymer if the linear synthetic polymer and the organic micropolymer are of like charge. In another configuration, application of the organic micropolymer is before one or more shear stages and the siliceous material is applied after the last shear point. Application of a substantially linear synthetic polymer of cationic, anionic or non ionic charge can be before the siliceous material, preferably before one or more shear points or concurrently with the organic micropolymer if of like charge.

FIG. 1 is a schematic diagram illustrating generally a paper making system 10 comprising a blend chest 12, a machine chest 14, and silo 16. Primary fan pump 17 can be used between silo 16 and cleaners 18. The material is then passed through deaerator 20. A secondary fan pump 21 can be located between deaearation 20 and screen(s) 22. The system further comprises head box 24, wire 25, and tray 28. The press section 30 is followed by dryers 32, size press 34, calendar stack 36, and finally reel 26. The diagram of FIG. 1 further illustrates the various points in the papermaking process where the additional flocculant/coagulant ("A" in diagram), the pretreatment coagulant and the cationic water-soluble coagulant ("B" in diagram), the organic micropolymer ("C" in diagram) and the siliceous material ("D" in diagram) can be added during the process.

Suitable amounts of each of the components of the flocculation system will depend on the particular component, the composition of the paper or paperboard being manufactured, and like considerations, and are readily determined without undue experimentation in view of the following guidelines. In general, the amount of siliceous material is 0.1 to 5.0 kg actives per metric ton (kg/MT) of dry fiber, specifically 0.05 to 5.0 kg/MT; the amount of organic micropolymer dispersion is 0.25 kg/MT to 5.0 kg/MT, specifically 0.05 to 3.0 kg/MT; and the amount of any one of the flocculants and flocculant/dispersant is 0.25 to 10.0 kg/MT, specifically 0.05 to 10.0 kg/MT. It is to be understood that these amounts are guidelines, but are not limiting, due to different types and amounts of actives in the solutions or dispersions:

The process disclosed herein can be used for making filled paper. The paper making stock comprises any suitable amount of filler. In some embodiments, the cellulosic suspension comprises up to 50 percent by weight of a filler, generally 5 to 50 percent by weight of filler, specifically 10 to 40 percent by weight of filler, based on the dry weight of the cellulosic suspension. Exemplary fillers include precipitated calcium carbonate, ground calcium carbonate, kaolin, chalk, talc, sodium aluminum silicate, calcium sulphate, titanium dioxide, and the like, and a combination comprising at least one of the foregoing fillers. Thus, according to this embodiment, a process is provided for making filled paper or paperboard, wherein a cellulosic suspension comprises a filler, and wherein the cellulosic suspension is flocculated by introducing a flocculation system comprising a siliceous material and an organic micropolymer as described previously. In other embodiments, the cellulosic suspension is free of a filler.

The invention is further illustrated by the following non-limiting examples. The components used in the examples are listed in Table 1.

TABLE 1

| Abbreviation | Component |
|---|---|
| PAM | Polyacrylamide flocculant |
| A-Pam | Anionic polyacrylamide flocculant |
| ANNP | Colloidal silica |
| ANMP | Anionic non-cross-linked micropolymer synthesized in a salt solution comprising acrylamide monomers and acrylic acid, having 30 mole percent anionic charge, and a reduced viscosity of greater than 10 dL/g. |
| ANMPP | Crosslinked micropolymer that is not polymerized in a salt solution, and is in an oil and water system |
| P-6,524,439 | ANMPP with colloidal silica as described in U.S. Pat. No. 6,524,439 |
| C-Pam | Linear cationic polyacrylamide flocculant |
| CatMP | Cationic micropolymer, comprising acrylamide and N,N-dimethylaminopropyl acrylamide units (water-in-water), having 25 mole percent cationic charge, and a reduced viscosity of greater than 10 dL/g |
| P-4,913,775 | Linear cationic polyacrylamide C-Pam with bentonite as described in U.S. Pat. No. 4,913,775 |
| PAC | Polyaluminum chloride coagulant |
| DDA | Dynamic drainage analyzer |
| VDT | Vacuum drainage tester |
| CatMP-SS | Cationic micropolymer dispersion in a salt solution, comprising acrylamide and 2-(dimethylamino)ethyl acrylate units, having 10 mole percent cationic charge, and a reduced viscosity of greater than 10 dL/g. |
| IMP-L | Laponite, an inorganic, hydrated, microparticulate silicate. |

EXAMPLE 1

The following example illustrates the advantages of using a combination of a siliceous material and a dispersion micropolymer in a salt solution in paper production. The siliceous material is ANNP, and the dispersion micropolymer in a salt solution is ANMP. The data is from a study done with a 100 percent wood-free uncoated free sheet furnish under alkaline conditions. The furnish contains precipitated calcium carbonate (PCC) filler at a level of 29 percent by weight, based on the total weight of the furnish. Table 1 displays a list of the abbreviations used below.

Figure 2:
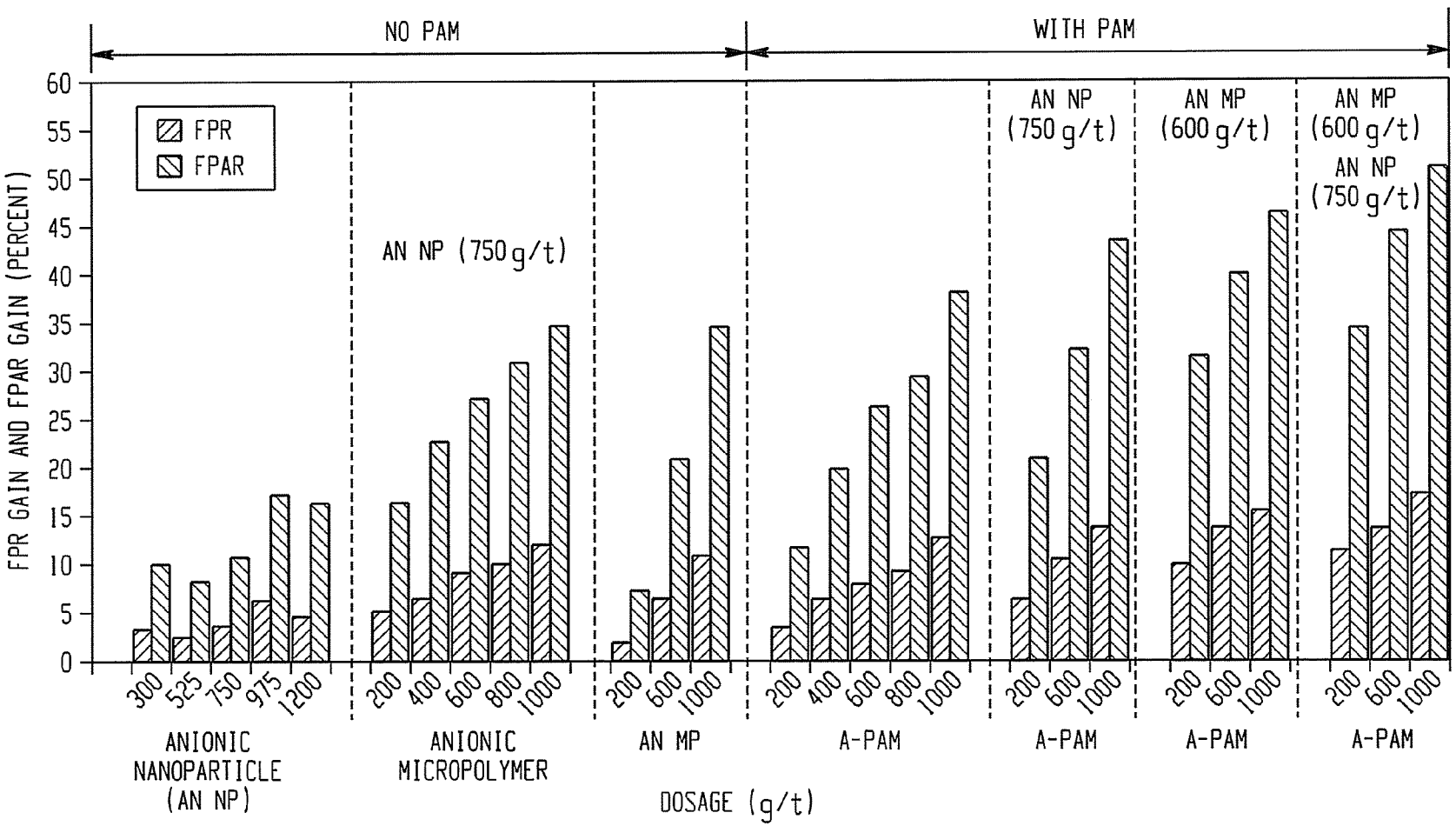
FIG. 2 is a graph of the retention data of Example 1 for a non wood-containing furnish.

The retention data are expressed in FIG. 2 as the percent improvements observed over a non-treated system for the retention parameters of first pass solids retention (FPR), and first pass ash retention (FPAR). For the no PAM portion of the study, a clear increase in efficiency is observed when both the ANMP and the ANNP are applied together. The improved performance is particularly evident at the lower application rates for these components. A similar response is observed for the portion of the evaluation that included the application of A-Pam. Again, the combination of the ANMP and the ANNP in the presence of A-Pam maximizes the retention response for both ash and total solids. Moreover, the data show that with the ANMP and ANNP combination program, the level of A-Pam required to obtain a desired level of retention of total solids or ash is significantly lower than with either single application of ANMP or ANNP. Lower levels of A-Pam are desirable when trying to increase retention as this will minimize the negative impact on formation. This is a primary quality goal of the finished paper/paperboard products.

EXAMPLE 2

The following example illustrates the advantage of applying a dispersion micropolymer in a salt solution with colloidal silica, in the presence of anionic polyacrylamide over the application of an oil in water emulsion micropolymer with colloidal silica in the presence of anionic polyacrylamide per the application described by U.S. Pat. No. 6,524,439. The data is from a study done with a 100 percent wood-free, uncoated, free sheet furnish under alkaline conditions. The furnish contains PCC filler at a level of 13 percent by weight.

Figure 3:
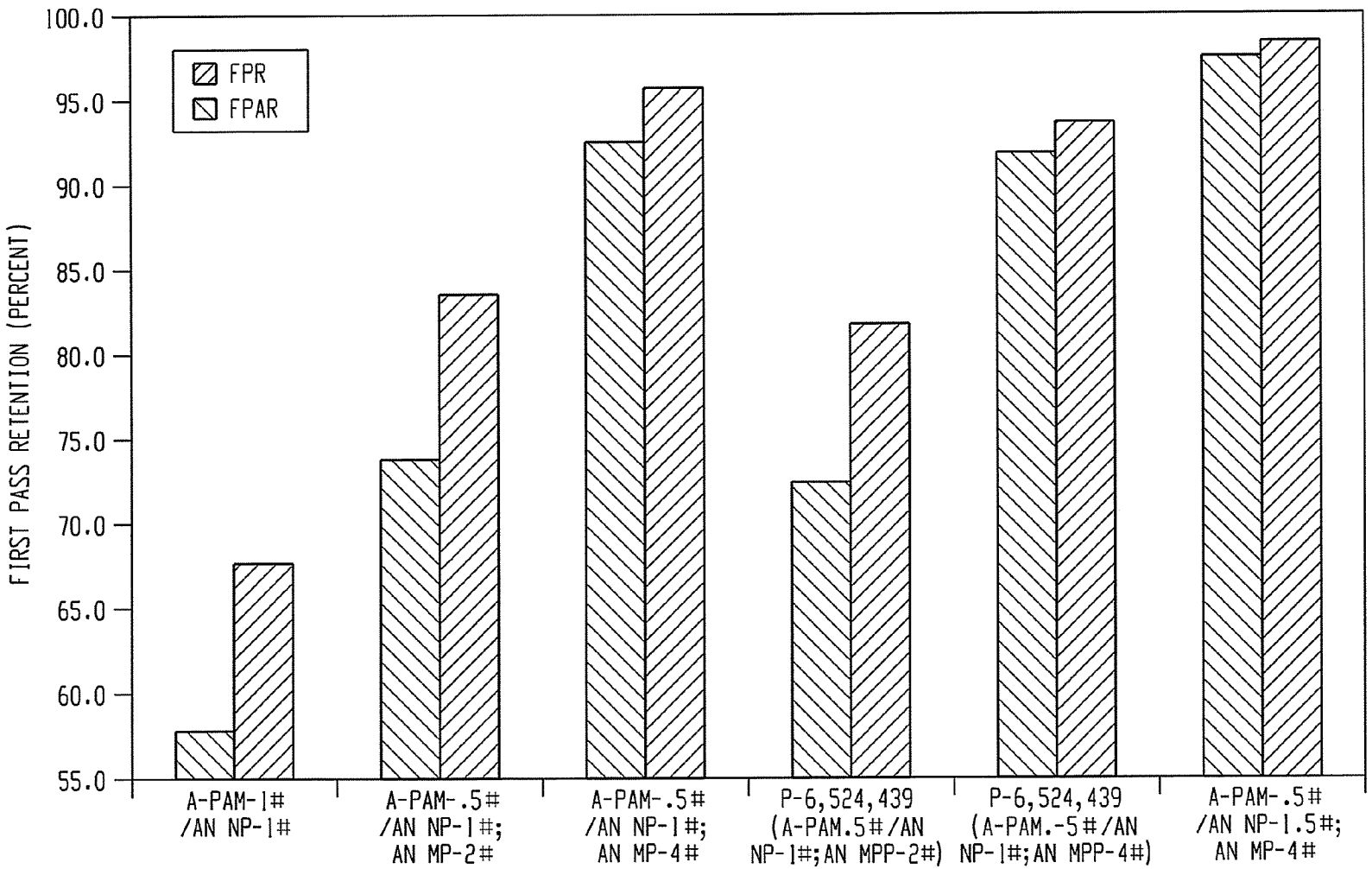
FIG. 3 is a graph of the retention data of Example 2 for a non wood containing furnish.

The data in FIG. 3 show that the highest retention response is achieved with the salt-based micropolymer and colloidal silica application. The retention efficiency of this chemistry is greater than the crosslinked oil and water emulsion application described per U.S. Pat. No. 6,524,439.

EXAMPLE 3

The following data is from a study done with a wood containing furnish comprising 70 percent by weight thermomechanical pulp (TMP), 15 percent by weight ground wood pulp, and 15 percent by weight bleached Kraft pulp used for super calendared (SC) paper production in alkaline conditions. The furnish contains PCC filler at a level of 28 percent by weight.

The results of this study show both retention and drainage rate data. Retention data are displayed in FIG. 4, while drainage rate data are displayed in FIG. 5 and FIG. 6. The data deal with PAC and C-Pam with a CatMP produced by polymerizing a monomer mixture containing a cationic monomer in an aqueous solution of a polyvalent salt applied with ANNP, PAC and C-Pam with ANMP produced by polymerizing a monomer mixture containing an anionic monomer in an aqueous solution of a polyvalent anionic salt applied with ANNP, and C-Pam with a swellable mineral as described in U.S. Pat. No. 6,524,439.

Figure 4:
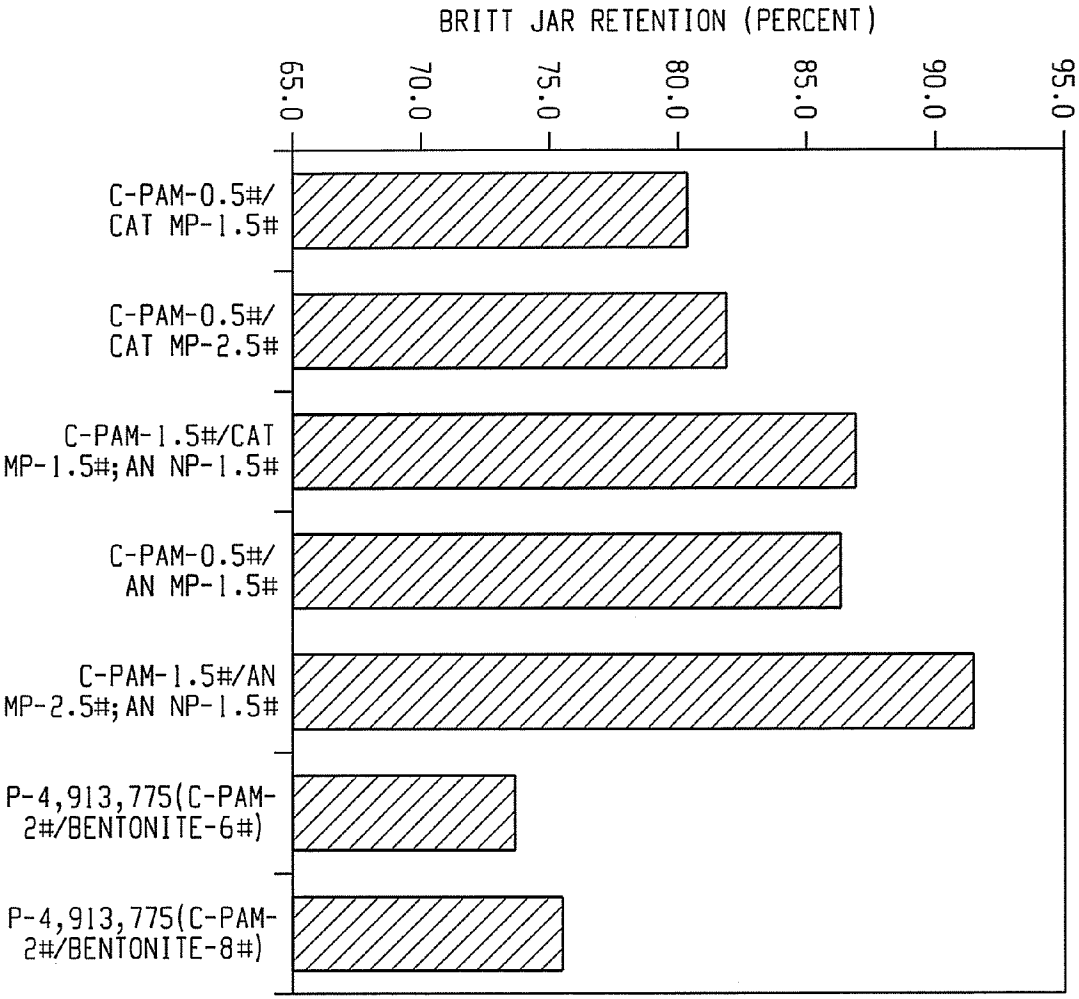
FIG. 4 is a graph of the retention data of Example 3 for a wood-containing furnish for super calendared grades.

The retention data in FIG. 4 illustrate the improved performance of the application using catMP applied with ANNP in the presence of C-Pam over the application using bentonite and C-Pam according to U.S. Pat. No. 6,524,439. Moreover, the application using ANMP with ANNP in the presence of C-Pam is superior to the applications including the application under U.S. Pat. No. 6,524,439.

Figure 5:
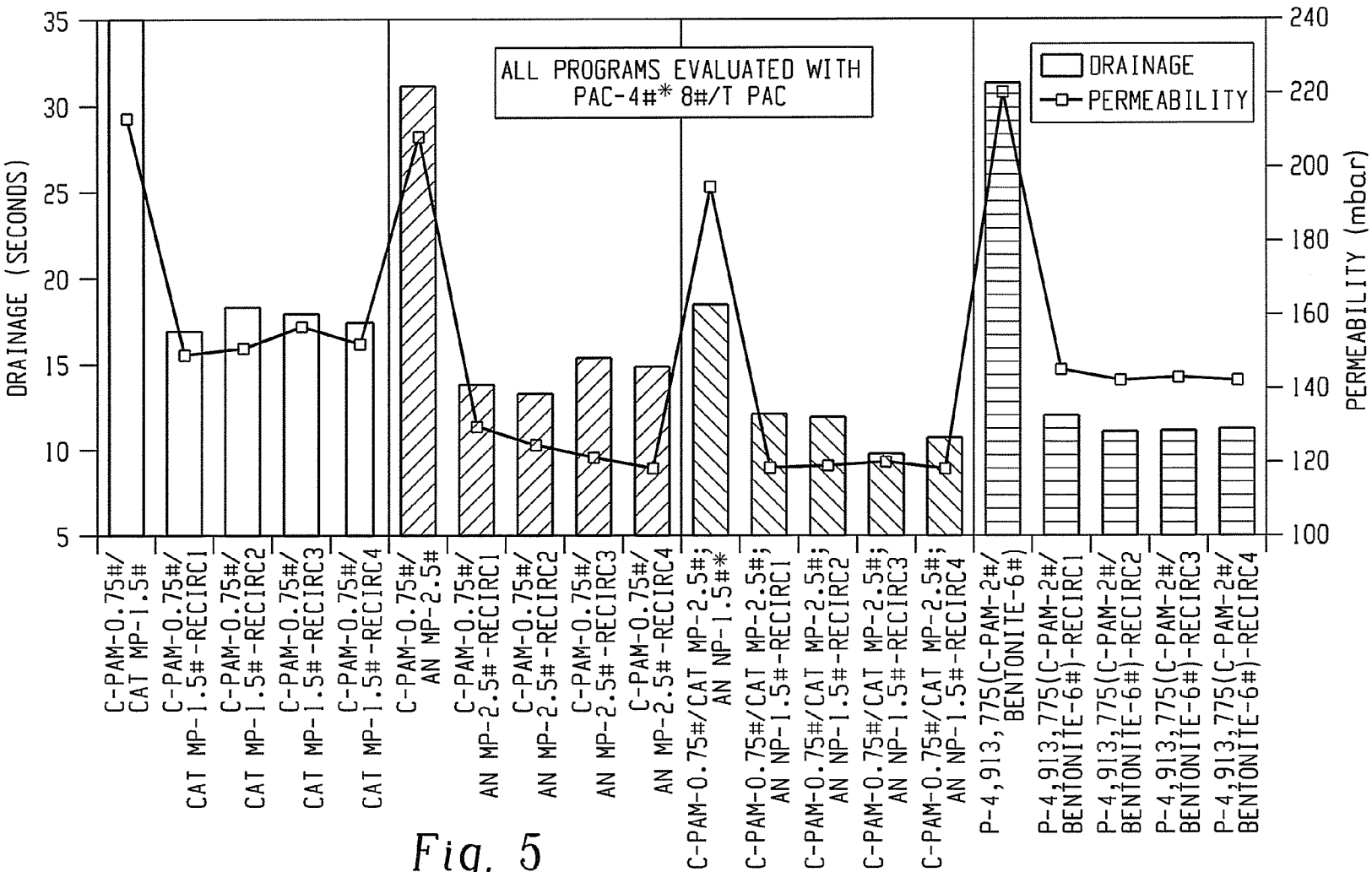
FIG. 5 is a graph of the drainage response via a dynamic drainage analyzer with recirculation for a wood-containing furnish for super calendared grades as in Example 3.

FIG. 5 shows the results from a drainage evaluation using a DDA where the filtrate is recirculated and used for subsequent iterations. This gives a close simulation to the fully scaled up process. In this study, the number of recirculations was 4. Parameters shown are drainage time and sheet permeability. FIG. 5 illustrates the increased performance achieved over an ANMP application alone in the presence of C-Pam and PAC when the ANMP is applied in conjunction with the ANNP, in the presence of C-Pam and PAC. The drainage performance of the ANMP/ANNP program is greater than the bentonite C-Pam application as described by U.S. Pat. No. 6,524,439. This is desirable on paper machines where furnish drainage limits production rate.

Figure 6:
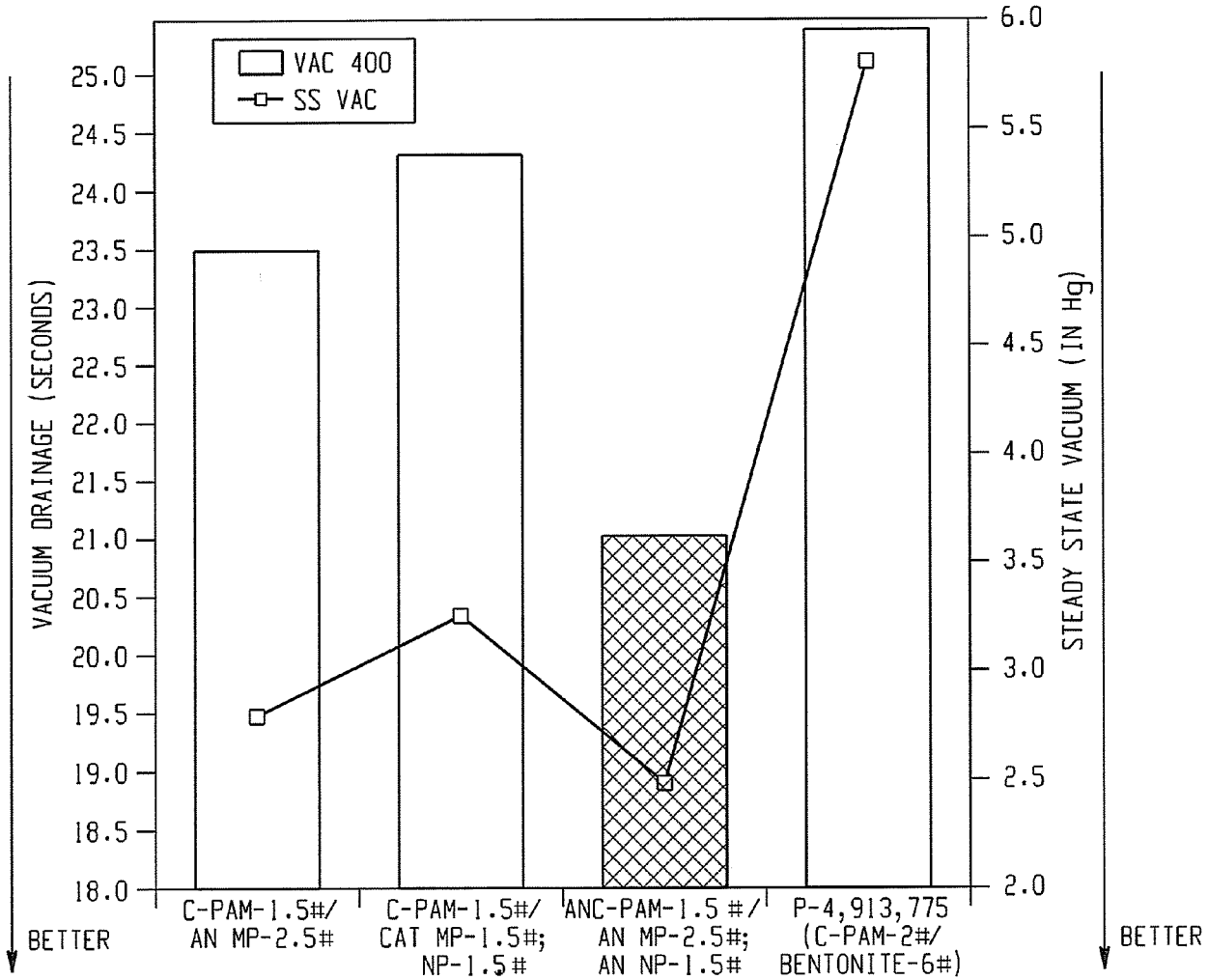
FIG. 6 is a graph of the drainage response under vacuum in a single pass for a wood-containing furnish for super calendared grades as in Example 3.

FIG. 6 depicts similar results to that observed in FIG. 5. FIG. 6 shows the drainage response results for a study using a VDT. This is a single pass test and similarly to the DDA, determines drainage time rate and sheet permeability. The ANMP applied in conjunction with ANNP in the presence of PAC and C-Pam gives the highest drainage rate. This rate is greater than that achieved by a swellable mineral application using bentonite per the application as described U.S. Pat. No. 6,524,439.

EXAMPLE 4

The following example illustrates the enhanced performance in the paper and board making process when the dispersion micropolymer in a salt solution is applied, alone or in combination with siliceous material, compared to when C-Pam is applied, alone or in combination with a siliceous material. The data is from a study done on wood containing furnish used for newsprint production under acidic conditions. The furnish comprises 5 percent by weight ash, predominantly kaolin. The dispersion micropolymer in a salt solution is CatMP-SS.

The drainage response was measured with a modified Schopper Reigler drainage tester using a single pass, while the retention characteristics were determined using a dynamic drainage jar. The results of this study are depicted in FIG. 7.

Figure 7:
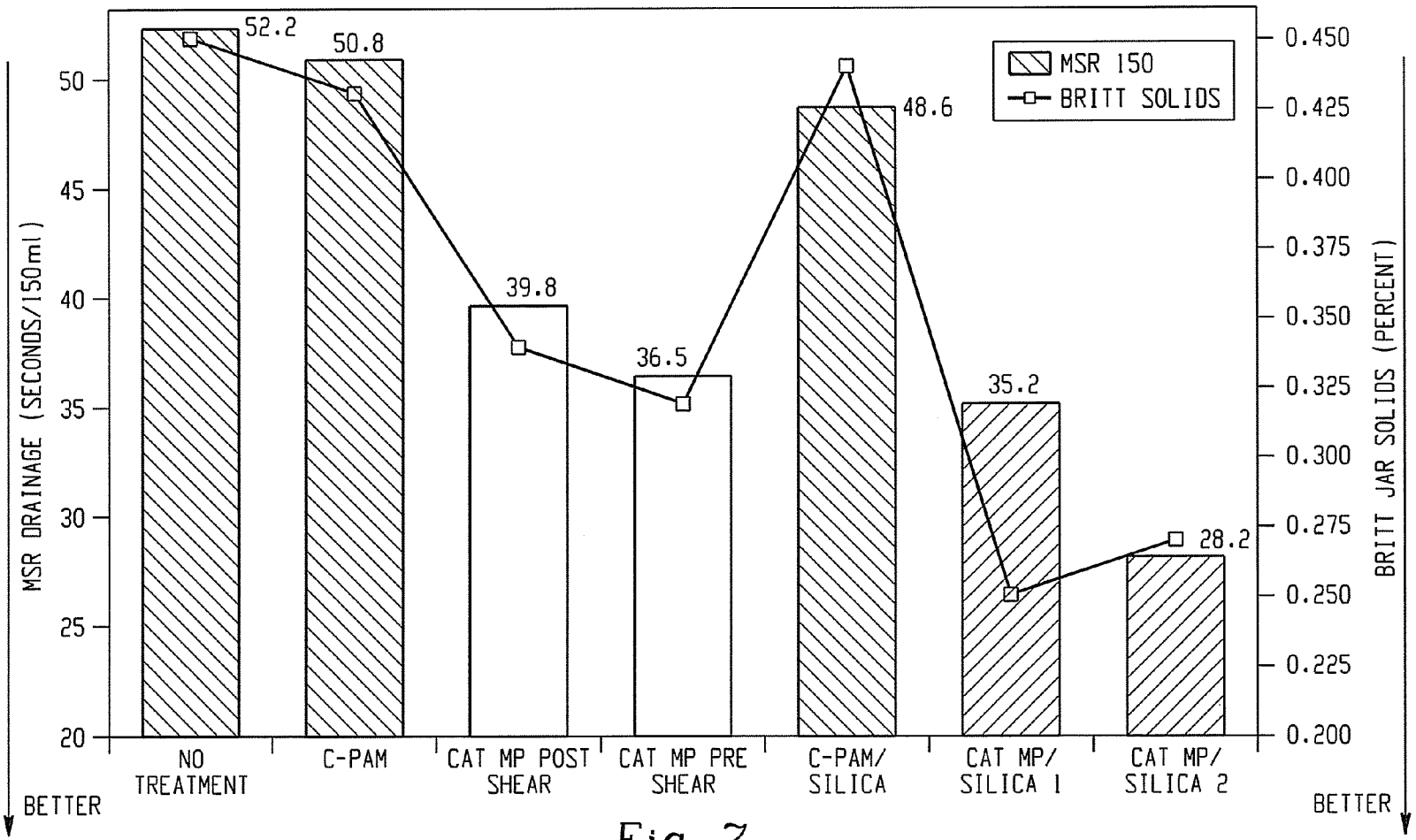
FIG. 7 is the graph of the drainage response and retention response in a single pass for Example 4.

The data in FIG. 7 illustrate the enhanced performance in the paper and board making process when CatMP-SS is applied, alone or in combination with ANNP, compared to when C-Pam is applied, alone or in combination with ANNP. An improvement in both the drainage and retention rates is observed. The data also indicate that it is advantageous to apply the CatMP-SS before a point of shear. Not wishing to be bound by any particular theory, it is believed that the improvement observed is due to the high degree of branching and charge within the CatMP-SS compared to polymers used in the art. When the CatMP-SS is sheared, the result is a higher degree of charge, an effect referred to as the ionic regain of a polymer. The data suggests that the CatMP-SS is giving ionic regain values greater than 100%, which is not possible when using a linear cationic polyacrylamide such as C-Pam. The ionic regain promotes reactivity with the siliceous material, such as ANNP, the latter not being very efficient under acidic conditions as known in the art. According to the data in FIG. 7, when ANNP is added to C-Pam, the net improvement in the drainage and retention response is negligible. On the other hand, when ANNP is added to CatMP-SS, the drainage and retention response is improved by over 20%.

EXAMPLE 5

The following example illustrates the advantages gained when the siliceous material is used in combination with the dispersion micropolymer in salt solution under acidic conditions, when compared to the use of the siliceous material in combination with regular polymers used in the art under acidic conditions. The data is from a study done on wood containing furnish used for newsprint production under acidic conditions. The furnish comprises 5 percent by weight ash, predominantly kaolin. The drainage retention and response were measured as discussed above.

Figure 8:
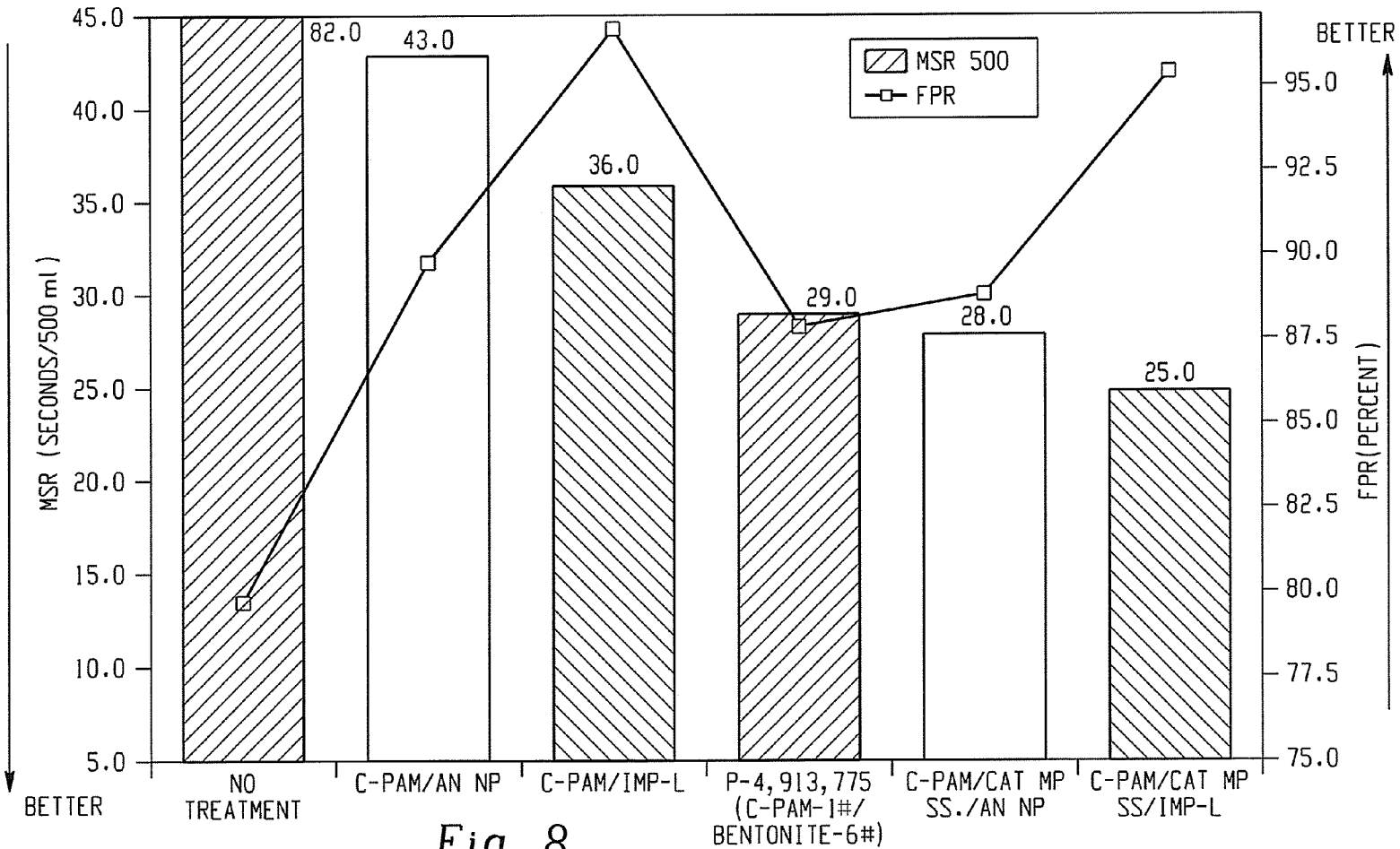
FIG. 8 is the graph of the drainage response and retention response in a single pass for Example 5.

The results are presented in FIG. 8. As expected, U.S. Pat. No. 4,913,775 shows that it is advantageous to add bentonite to C-Pam as opposed to adding ANNP or IMP-L to C-Pam, because the system is under acidic conditions. However, when CatMP-SS is added to the combination of C-Pam and the siliceous material, the drainage performance is enhanced by more than 30% for the IMP-L system and more than 40% for the ANNP system. The combination of CatMP-SS with C-Pam and the siliceous material outperforms the combination of C-Pam and the siliceous material without CatMP-SS as per U.S. Pat. No. 4,913,775. This result highlights the advantages of CatMP-SS as discussed in Example 4.

EXAMPLE 6

The following example illustrates the advantages gained when bentonite is used in combination with a cationic salt dispersion micropolymer under alkaline conditions. The data is from a mill trial on wood containing furnish used for SC production under alkaline conditions using PCC as a filler. The objectives of the trial were to develop a new papergrade with high grammage (greater than 60 g/m$^2$ and high brightness. The furnish comprised 5-10 percent by weight ash, predominantly PCC. The furnish is 70-80% PGW, 20-30% Kraft and 15-25% broke. Operating pH was 7.2-7.5 with a cationic demand of −100 meq/L and a free calcium content of 100-200 ppm. The machine operating parameters were: HB consistency=1.5%, white water consistency=0.6%, FPR=50-55%, and FPAR=30-35%. The current chemistry on the machine was: 200-300 grams per ton (g/t) of cationic polyacrylamide after pressure screens, 3 kg/t bentonite before pressure screens, 12-15 kg/t cationic starch calculated on PGW dry flow, with OBA added to suction of blend chest pump at rate 0-4 kg/t.

Figure 9:
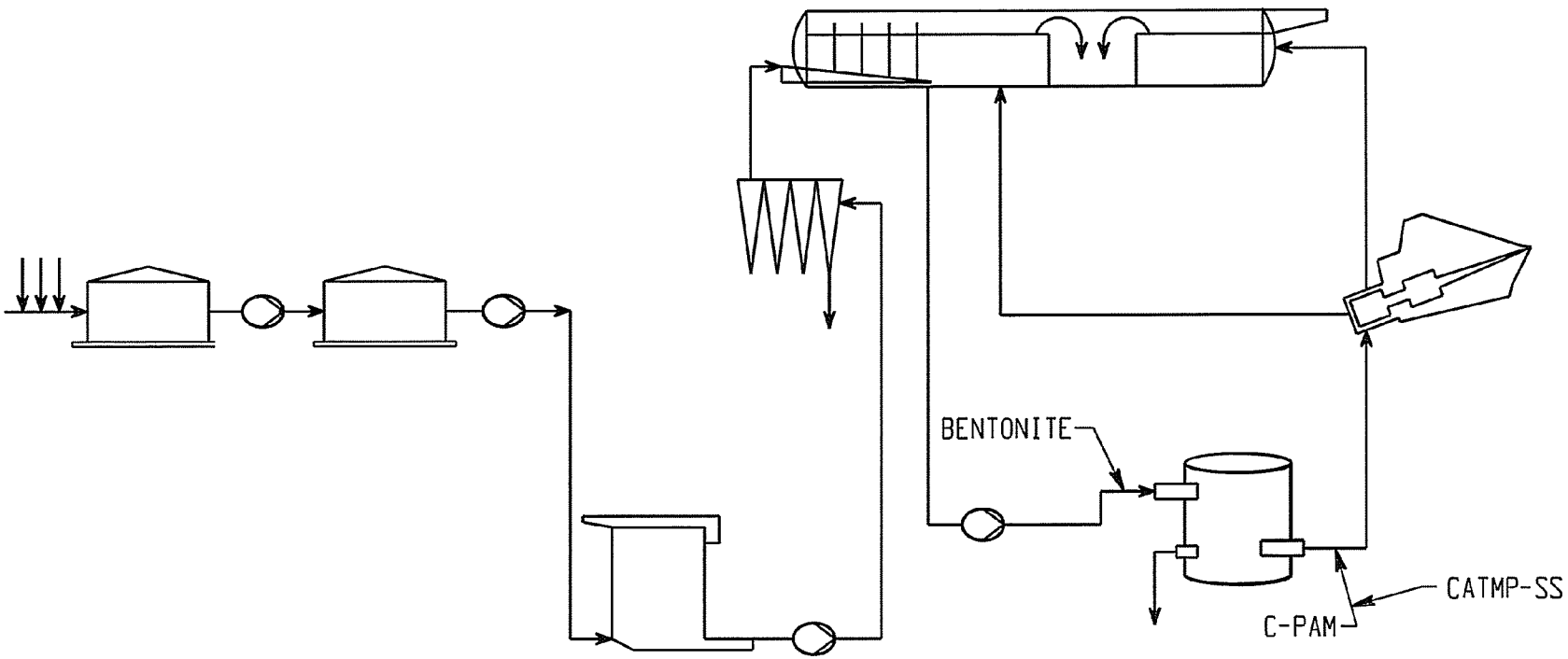
FIG. 9 is a schematic diagram illustrating the papermaking process described in Example 6, showing simultaneous addition of CatMP-SS to the combination of C-Pam and bentonite.

As expected, it was advantageous to add C-PAM to bentonite, as it improved the drainage characteristics of the furnish. However, when CatMP-SS was added to the combination of C-Pam and the bentonite (where the CatMP-SS was added simultaneously with the C-PAM, see FIG. 9), the drainage performance was enhanced by more than 20%. FIG. 9 is a schematic diagram illustrating the papermaking system 100 and process described in Example 6, showing simultaneous addition of CatMP-SS to the combination of C-Pam and bentonite. Papermaking system 100 comprises mixing chest 112, machine chest 114, wire pit 116, and cleaners 118, followed by deaerator 120, head box 124, and selectifier (pressure) screen 122.

Figure 10:
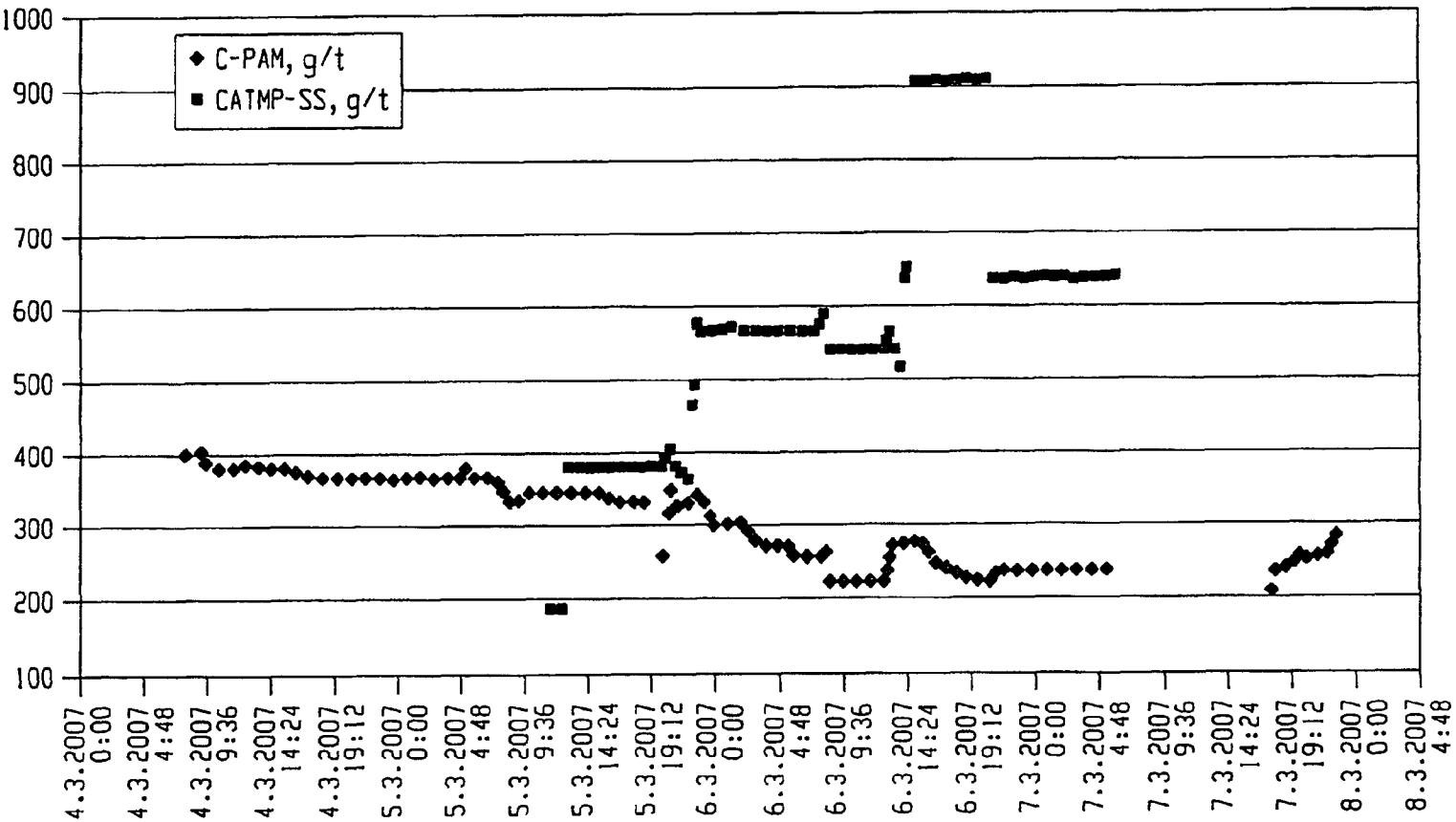
FIG. 10 is a timeline showing the dosages (g/ton) of the polymer additives (C-PAM and CatMP-SS) used in Example 6, wherein the amount of bentonite is held constant.

The combination of CatMP-SS with C-Pam and the siliceous material outperformed the combination of C-Pam and the siliceous material without CatMP-SS. Results are presented in FIGS. 10-13. FIG. 10 is a timeline showing the dosages (g/ton) of the polymer additives (C-PAM and CatMP-SS) used in Example 6, wherein the amount of bentonite is held constant.

Figure 11:
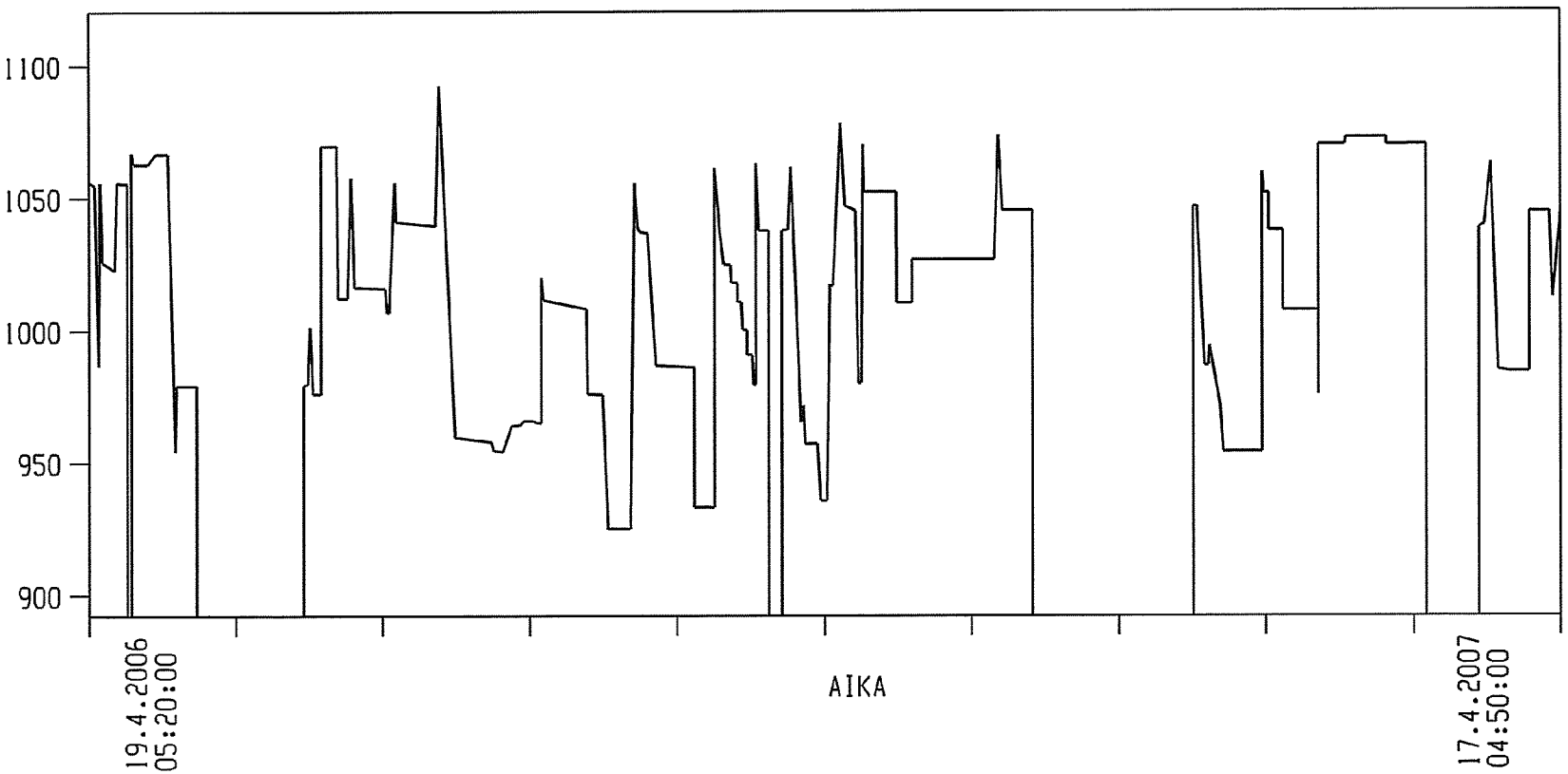
FIG. 11 shows a record of the reel speed for a paper machine over time.

FIG. 11 shows a record of the reel speed for a paper machine over time (one year) using a basis weight of 65 g/m$^2$. Example 6 was run over the indicated time 200. As can be seen from this Figure, use of the process of Example 6 allowed a uniformly high reel speed at a higher weight.

Figure 12:
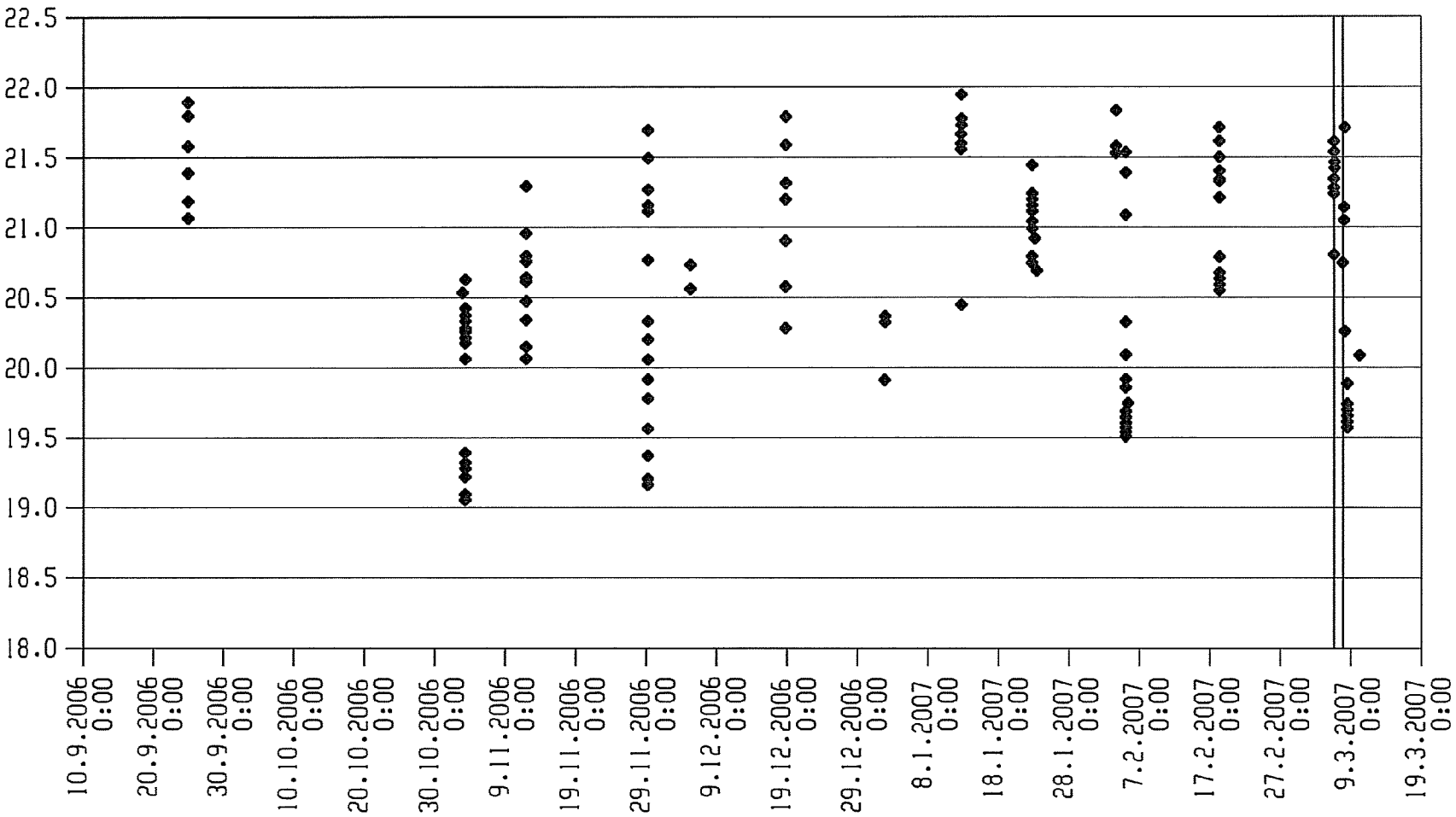
FIG. 12 shows production rate over a period of time for a papermaking process.

FIG. 12 shows rate of production over a period of time for a papermaking process. In FIG. 12, the period of time (six months) including the process of Example 6, which is indicated at 300. As can be seen, production rate was high during this period.

Figure 13:
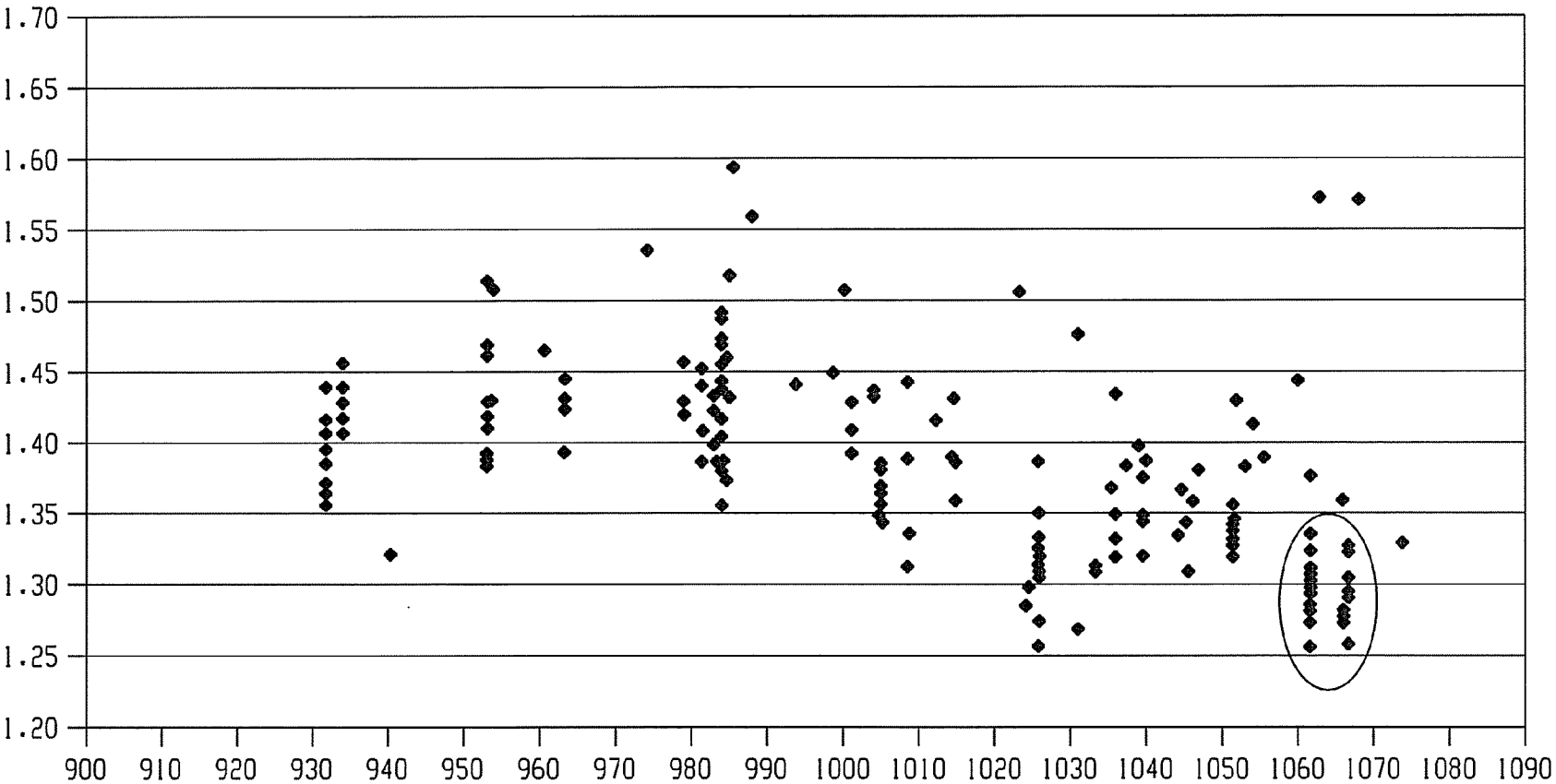
FIG. 13 shows the overall efficiency of a papermaking process as reflected by steam/paper (ton) vs. reel speed.

FIG. 13 shows the overall efficiency of a papermaking process, wherein data for Example 6 is indicated at 400. Again, efficiency during this period is very good.

The terms "a" and "an" do not denote a limitation of quantity, but rather denote the presence of at least one of the referenced item." The term "water-soluble" refers to a solubility of at least 5 grams per 100 cubic centimeters of water.

All cited patents, patent applications, and other references are incorporated herein by reference in their entirety as though set forth in full.

While the invention has been described with reference to some embodiments, it will be understood by those skilled in the art that various changes can be made and equivalents can be substituted for elements thereof without departing from the scope of the invention. In addition, many modifications can be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A process for making paper or paperboard, comprising:
forming a cellulosic suspension;
passing the cellulosic suspension through one ore more shear stages;
draining the cellulosic suspension on a screen to form a sheet; and
drying the sheet;
wherein the cellulosic suspension is flocculated before draining by adding a flocculation system comprising greater than or equal to 0.01 percent by weight of:
an organic micropolymer in an inorganic salt solution, and
an inorganic siliceous material;
wherein the organic micropolymer and the inorganic siliceous material are added after one of the shear stages;
wherein the organic micropolymer and the inorganic siliceous material are added simultaneously or sequentially;
wherein the flocculation system further comprises an organic water-soluble flocculant material comprising a substantially linear synthetic cationic, non-ionic, or anionic polymer, having molecular weight greater than or equal to 500,000 atomic mass units, that is added to the cellulosic suspension before the shear stage in an amount such that flocs are formed;
wherein the flocs are broken by the shearing to form microflocs that resist further degradation by the shearing, and that carry sufficient anionic or cationic charge to interact with the siliceous material and the organic micropolymer to give better retention than that which is obtained when adding the flocculation system after the last point of high shear without first adding the flocculant material to the cellulosic suspension;
wherein percent by weight is based on the total weight of the dry cellulosic suspension wherein the organic micropolymer is an organic water soluble, anionic or cationic, water-in-water or dispersion micropolymer composition.

2. The process of claim 1, wherein the dispersion micropolymer composition has a reduced viscosity greater than or equal to 0.2 deciliters per gram and comprises 5 to 30 weight percent of a high molecular weight micropolymer and 5 to 30 weight percent of an inorganic coagulative salt.

3. The process of claim 2, wherein the dispersion micropolymer composition exhibits a solution viscosity of greater than or equal to 0.5 centipoise (millipascal-second).

4. The process of claim 2, wherein the dispersion micropolymer composition solution has an ionicity of at least 5.0%.

5. The process of claim 2, wherein the monomer is acrylamide, methacrylamide, diallyldimethylammonium chloride, dimethylaminoethyl acrylate methyl chloride quaternary salt, dimethylaminoethyl methacrylate methyl chloride quaternary salt, acrylamidopropyltrimethylammonium chloride, methacrylamidopropyltrimethylammonium chloride, acrylic acid, methacrylic acid, sodium acrylate, sodium methacrylate, ammonium methacrylate, or a combination comprising at least one of the foregoing monomers.

6. The process of claim 5, wherein the monomer comprises greater than or equal to 2 mole percent of a cationic or anionic monomer, based on the total number of moles of monomer.

7. The process of claim 1, wherein the dispersion micropolymer composition is prepared by initiating polymerization of a polymerizable monomer in an aqueous salt solution to form an organic micropolymer dispersion, the resulting dispersion having a reduced viscosity greater than or equal to 0.2 deciliters per gram.

8. The process of claim 7, wherein the salt solution is an aqueous solution of an inorganic polyvalent ionic salt, and wherein the salt solution further comprises 1 to 30 percent by weight, based on the total weight of the monomers, of a dispersant polymer, the dispersant polymer being a water-soluble anionic or cationic polymer that is soluble in the aqueous solution of the polyvalent ionic salt.

9. The process of claim 8, wherein the inorganic polyvalent ionic salt comprises an aluminum, potassium or sodium cation and a sulfate, nitrate, phosphate, or chloride anion.

10. The process of claim 8, wherein the dispersant polymer is a water-soluble anionic polymer.

11. The process of claim 1, wherein the water-in-water micropolymer composition comprises a high molecular weight phase having a reduced viscosity greater than or equal to 0.2 dl/g, and synthesized within an organic coagulant having a reduced viscosity below 4 dl/g.

12. The process of claim 11, wherein the water-in-water micropolymer composition has a solution viscosity of greater than or equal to 0.5 centipoise.

13. The process of claim 11, wherein the water-in-water micropolymer composition has an ionicity of at least 5.0%.

14. The process of claim 1, wherein the siliceous material is an anionic microparticulate or nanoparticulate silica-based material.

15. The process of claim 1, wherein the siliceous material is a bentonite clay.

16. The process of claim 1, wherein the siliceous material comprises silica based particles, silica microgels, colloidal silica, silica sols, silica gels, polysilicates, aluminosilicates, polyaluminosilicates, borosilicates, polyborosilicates, zeolites, swellable clay, and combinations thereof, and wherein the siliceous material is of the material selected from the list consisting of hectorite, smectites, montmorillonites, nontronites, saponite, sauconite, hormites, attapulgites, laponite, sepiolites, or a combination comprising at least one of the foregoing materials.

17. The process of claim 1, wherein the siliceous material is introduced into the suspension before the organic micropolymer.

18. The process of claim 17, wherein the flocculant/coagulant is a water-soluble polymer.

19. The process of claim 1, wherein the organic micropolymer is introduced into the suspension before the siliceous material.

20. The process of claim 19, wherein the water-soluble polymer is formed from a water-soluble, ethylenically unsaturated monomer, or a water-soluble combination of ethylenically unsaturated monomers comprising at least one type of anionic or cationic monomers.

21. The process of claim 1, wherein the cellulosic suspension is treated by the introduction of a flocculant prior to the introduction of the siliceous material and the organic micropolymer.

22. The process of claim 21, wherein the flocculant is a cationic material selected from the group consisting of water-soluble cationic organic polymers, polyamines, poly(diallyldimethylammonium chloride), polyethyleneimine, inorganic materials such as aluminum sulfate, polyaluminum chloride, aluminum chloride trihydrate, aluminum chlorohydrate, and combinations thereof.

23. The process of claim 1 wherein the flocculation system additionally comprises at least one flocculant/coagulant.

24. The process of claim 1, wherein the cellulosic suspension is first flocculated by introducing the coagulating material, then is optionally subjected to mechanical shear, and then is reflocculated by introducing the siliceous material and the micropolymer composition.

25. The process of claim 24, wherein the cellulosic suspension is reflocculated by introducing the siliceous material before the micropolymer composition.

26. The process of claim 24, wherein the cellulosic suspension is reflocculated by introducing the organic micropolymer before the siliceous material.

27. The process of claim 1, wherein the cellulosic suspension comprises a filler in an amount of 0.01 to 50 percent by weight, based on the total dry weight of the cellulosic suspension.

28. The process of claim 27, wherein the filler is selected from the group consisting of precipitated calcium carbonate, ground calcium carbonate, kaolin, chalk, talc, sodium aluminum silicate, calcium sulphate, titanium dioxide and combinations thereof.

29. The process of claim 1, wherein the cellulosic suspension is substantially free of filler.

30. The process of claim 1, wherein the one or more shear stages is cleaning, mixing, pumping, or a combination comprising at least one of the foregoing shear stages.

31. The process of claim 1, wherein the one or more shear stages comprise a centriscreen, and wherein the coagulating material is added to the cellulosic suspension before the centriscreen, and the siliceous material and organic micropolymer are added after the centriscreen.

32. The process of claim 1, wherein the one or more shear stages compromise a centriscreen, which can be between the application of the flocculation system of micropolymer and the siliceous material; wherein the siliceous material is applied before one or more shear stages and the organic micropolymer is applied after the last shear point; and wherein application of the substantially linear synthetic polymer of either cationic, anionic or non ionic is applied after the last shear point either before the organic micropolymer or concurrently with the organic micropolymer if the linear synthetic polymer and the organic micropolymer are of like charge.

33. The process of claim 1, wherein the one or more shear stages compromise a centriscreen, which can be between the application of the flocculation system of micropolymer and the siliceous material; wherein the organic micropolymer is applied before one or more shear stages and the siliceous material is applied after the last shear point; and wherein application of a substantially linear synthetic polymer of either cationic, anionic or non ionic charge is applied before the siliceous material preferably before one or more shear points or concurrently with the organic micropolymer if of like charge.

* * * * *